US008678537B2

(12) United States Patent
Suzuki et al.

(10) Patent No.: US 8,678,537 B2
(45) Date of Patent: Mar. 25, 2014

(54) FEED CONTROL APPARATUS, RECORDING APPARATUS, CONTROL METHOD, AND RECORDING MEDIUM

(75) Inventors: Arata Suzuki, Kanagawa (JP); Nobuyuki Satoh, Kanagawa (JP); Masato Kobayashi, Kanagawa (JP); Yuichi Sakurada, Kanagawa (JP); Tatsuhiko Okada, Saitama (JP); Daisaku Horikawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 238 days.

(21) Appl. No.: 12/926,885

(22) Filed: Dec. 15, 2010

(65) Prior Publication Data

US 2011/0148971 A1 Jun. 23, 2011

(30) Foreign Application Priority Data

Dec. 22, 2009 (JP) ..... 2009-290371

(51) Int. Cl.
*B41J 29/38* (2006.01)
*B41J 29/393* (2006.01)
*B41J 2/01* (2006.01)

(52) U.S. Cl.
USPC ..... 347/16; 347/14; 347/19; 347/101

(58) Field of Classification Search
USPC ..... 347/14, 16, 19, 101
See application file for complete search history.

(56) References Cited

U.S. PATENT DOCUMENTS 8,104,692 B2 * 1/2012 Sjolander et al. ..... 235/494
2004/0179885 A1 * 9/2004 Adkins et al. ..... 400/636.1
2009/0237437 A1 9/2009 Uchida

FOREIGN PATENT DOCUMENTS

JP 2006-030711 A 2/2006
JP 2007-261262 A 10/2007

* cited by examiner

*Primary Examiner* — Jason Uhlenhake
(74) *Attorney, Agent, or Firm* — Harness, Dickey & Pierce, P.L.C.

(57) ABSTRACT

A disclosed feed control apparatus includes a feed roller; a first detection unit detecting a rotational position of the feed roller; a sensor detecting plural marks arranged on a test chart; a difference calculation unit that calculates a difference between actual and theoretical positional information of a Nth mark when the feed roller rotates one revolution; a correction feeding amount calculation unit that calculates correction feeding amounts of the marks based on the difference and actual feeding amounts of the marks; an error calculation unit that calculates errors between the correction feeding amounts and theoretical feeding amounts by matching them to the corresponding rotational positions of the feeding roller; and a feeding amount control unit that controls the feeding amount based on a relationship between the rotational positions of the feeding roller and the corresponding errors.

7 Claims, 18 Drawing Sheets

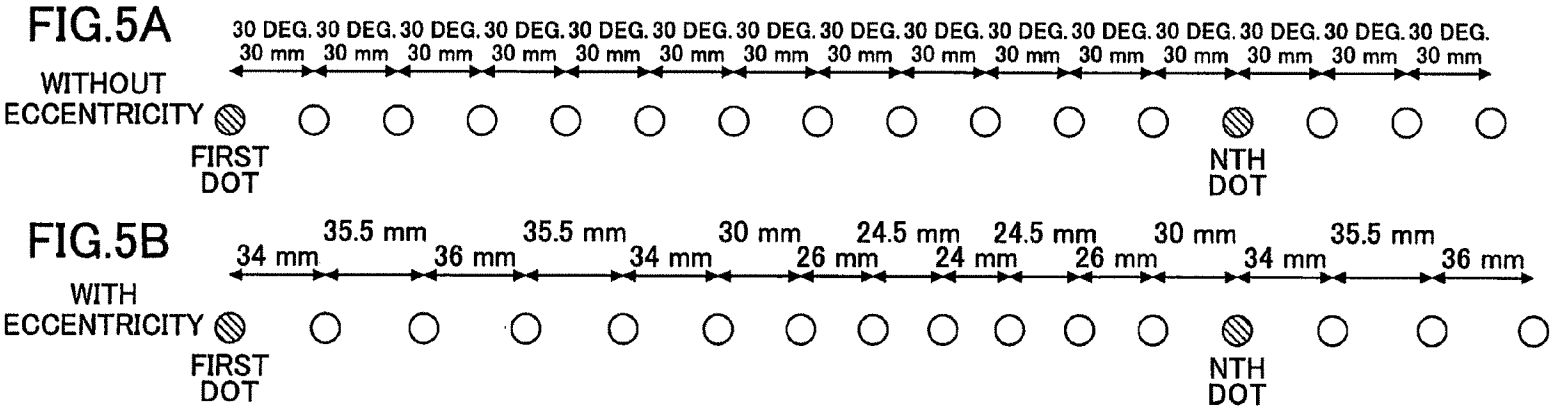
FIG.5A
WITHOUT ECCENTRICITY
FIRST DOT
NTH DOT
30 DEG. 30 DEG. 30 DEG. 30 DEG. 30 DEG. 30 DEG. 30 DEG. 30 DEG. 30 DEG. 30 DEG. 30 DEG. 30 DEG.
30 mm 30 mm 30 mm 30 mm 30 mm 30 mm 30 mm 30 mm 30 mm 30 mm 30 mm 30 mm
FIG.5B
WITH ECCENTRICITY
FIRST DOT
NTH DOT
34 mm 35.5 mm 36 mm 35.5 mm 34 mm 30 mm 26 mm 24.5 mm 24 mm 24.5 mm 26 mm 30 mm 34 mm 35.5 mm 36 mm
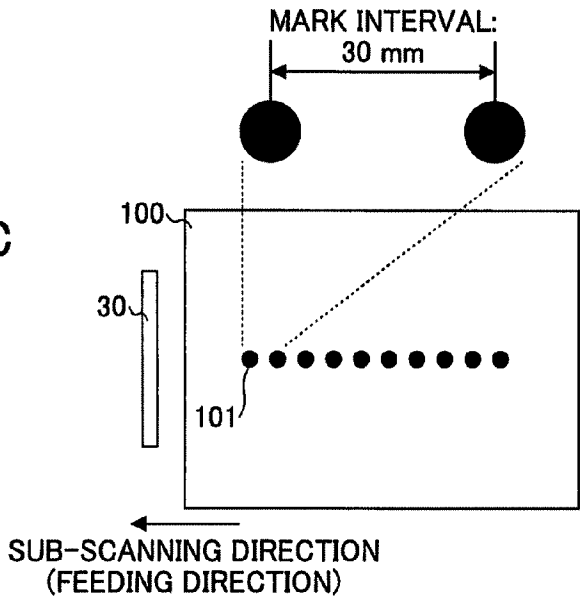
FIG.5C
MARK INTERVAL: 30 mm
100
101
30
SUB-SCANNING DIRECTION (FEEDING DIRECTION)

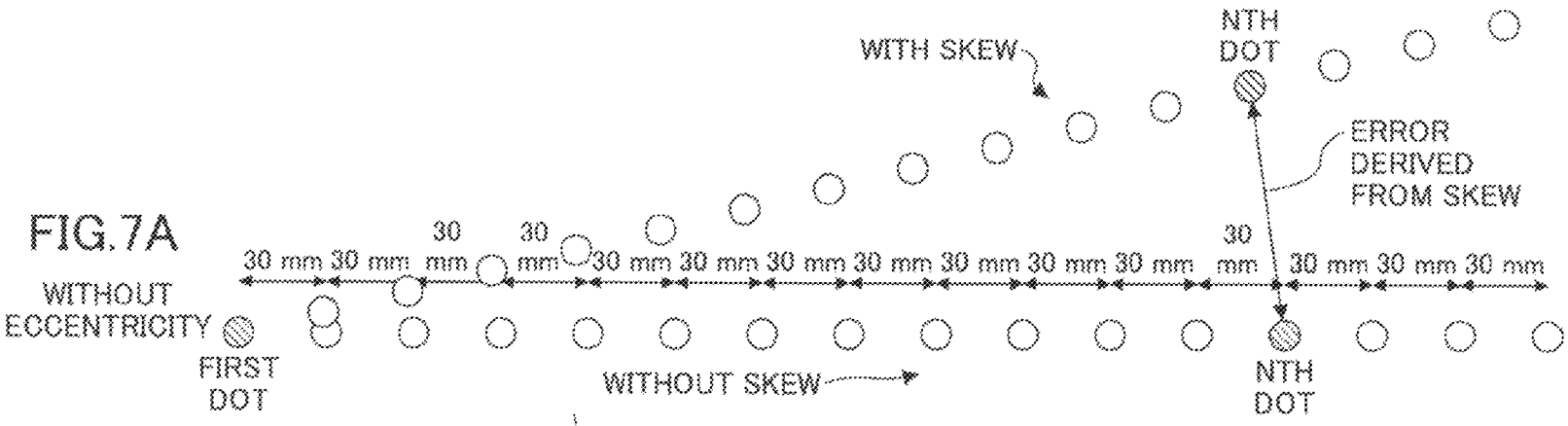
WITH SKEW
NTH DOT
ERROR DERIVED FROM SKEW
NTH DOT
WITHOUT SKEW
30 mm
30 mm
30 mm

FEED CONTROL APPARATUS, RECORDING APPARATUS, CONTROL METHOD, AND RECORDING MEDIUM

CROSS-REFERENCE TO RELATED APPLICATIONS

The present application claims priority under 35 U.S.C §119 based on Japanese Patent Application No. 2009-290371 filed Dec. 22, 2009, the entire contents of which are hereby incorporated herein by reference.

BACKGROUND OF THE INVENTION

1. Field of the Invention

The present invention generally relates to a recording apparatus such as an inkjet printer.

2. Description of the Related Art

In an inkjet-type recording apparatus, ink is discharged from a recording head mounted on a carriage while the carriage moves back and forth in the main-scanning direction, so that ink can be adhered onto a recording medium placed on a platen plate to record a line image (dots) on the recording medium. Further, the recording medium is fed in the sub-scanning direction (perpendicular to the main-scanning direction) using a feeding roller and the like and a recording process in the main-scanning direction is repeated to form an image on the recording medium.

However, in the inkjet-type recording apparatus, there may be a problem where a feeding amount of the recording medium varies when the recording media is fed using a feeding roller depending on installation conditions of the feeding roller, eccentricity level of the feeding roller, a type of the recording medium and the like. When the feeding amount of the recording medium varies, the dots of the image may be formed on the positions which differ from the respective desired positions.

To resolve the problem, in the related art of the present invention, for example, Japanese Patent Application Publication No. 2007-261262 ("Patent Document 1") discloses a technique in which a test pattern to be formed on a recording medium is recorded. Then, the based on the recorded test pattern, a positional displacement amount in the feeding direction of the recording medium is detected, so that the rotation of the feeding roller is controlled.

However, in a technique such as disclosed in Patent Document 1, if the nozzles to be used for forming the test pattern have a problem due to a missing nozzle, a bent nozzle or the like, an accurate test pattern may not be formed. Further, if the positional displacement amount obtained based on such an inaccurate test pattern is used for controlling (correcting) the rotation of the feeding roller, wrong control may be executed. As a result, accurate control of the rotation of the feeding roller may not be achieved.

SUMMARY OF THE INVENTION

The present invention is made in light of the above circumstances, and may provide a feed control apparatus, a recording apparatus, a control method, and a recording medium capable of reducing the variation of the feeding amount provided by the feeding roller.

According to an embodiment of the present invention, a feed control apparatus has the following features.

According to an aspect of the present invention, a feed control apparatus includes a feed roller that feeds a medium; a first detection unit that detects a rotational position of the feed roller; a sensor that detects plural marks when a test chart is fed by the feed roller, the plural marks being arranged on the test chart, the test chart being provided for adjusting feeding amounts of the feed roller; a difference calculation unit that calculates a difference between actual positional information of an Nth (N: an integer) mark actually detected by the sensor when the feed roller rotates one revolution and theoretical positional information of the Nth mark ideally detected by the sensor when the feed roller rotates one revolution; a correction feeding amount calculation unit that calculates each of correction feeding amounts of the marks based on the differences calculated by the difference calculation unit and corresponding actual feeding amounts of the marks obtained by detecting the marks using the sensor; an error calculation unit that calculates each of errors between the correction feeding amounts of the marks calculated by the correction feeding amount calculation unit and corresponding predetermined theoretical feeding amounts by corresponding the errors to the rotational positions of the feeding roller; and a feeding amount control unit that controls the feeding amounts of the feed roller based on a relationship between the rotational positions of the feeding roller and the corresponding errors calculated by the error calculation unit.

BRIEF DESCRIPTION OF THE DRAWINGS

Other objects, features, and advantages of the present invention will become more apparent from the following description when read in conjunction with the accompanying drawings, in which:

FIGS. 5A through 5C are drawings illustrating where the test (detected) data are not skewed;

FIGS. 7A and 7B are drawings illustrating where the test data are skewed;

DETAILED DESCRIPTION OF THE PREFERRED EMBODIMENTS

Outline of Feed Control Apparatus

First, a feed control apparatus according to an embodiment of the present invention is briefly described with reference to FIGS. 2, 3, 5, 6, and 8 through 11B.

Figure 3:
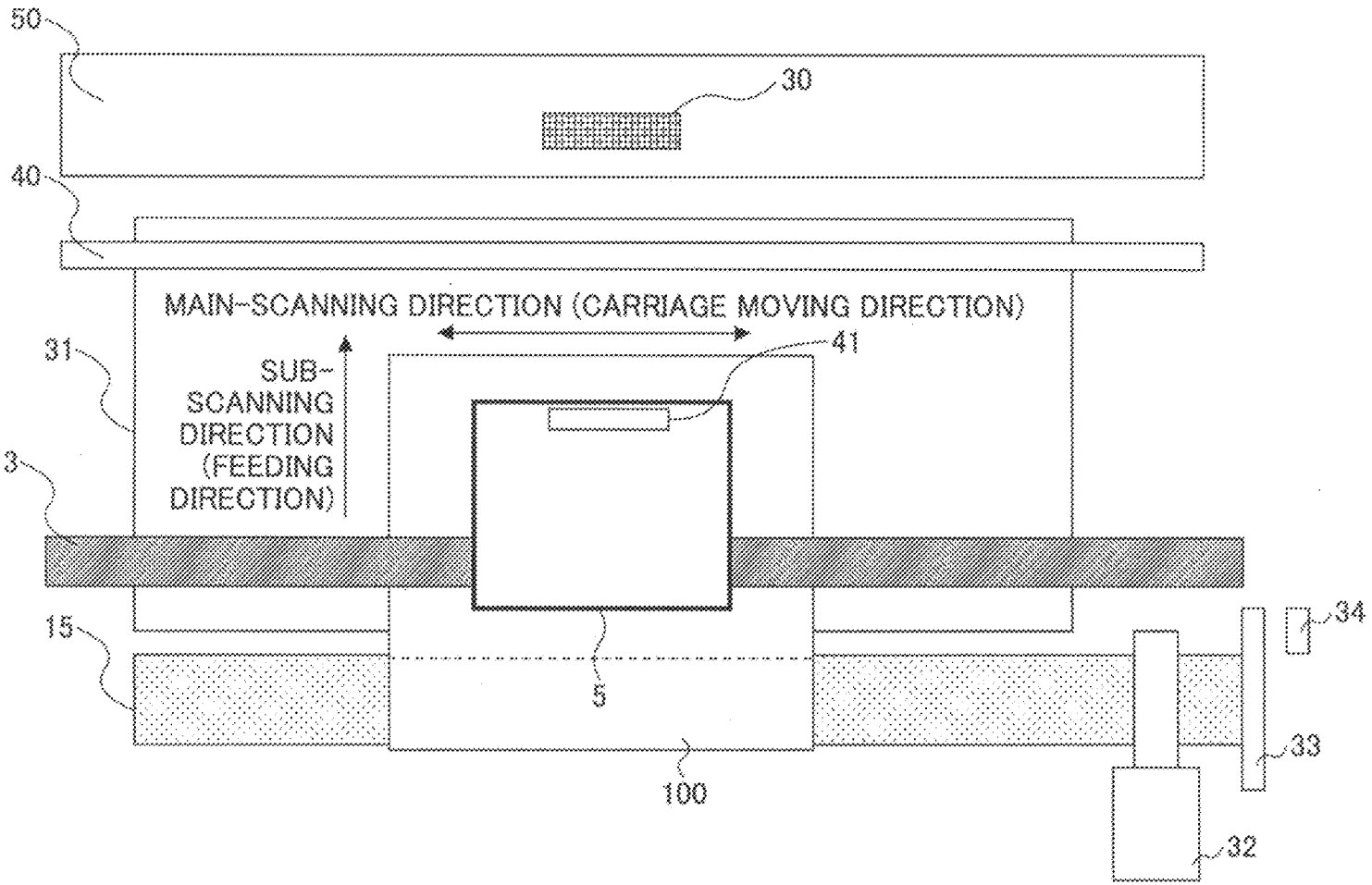
FIG. 3 is an enlarged drawing illustrating an area of a carriage of the recording apparatus.
Figure 9:
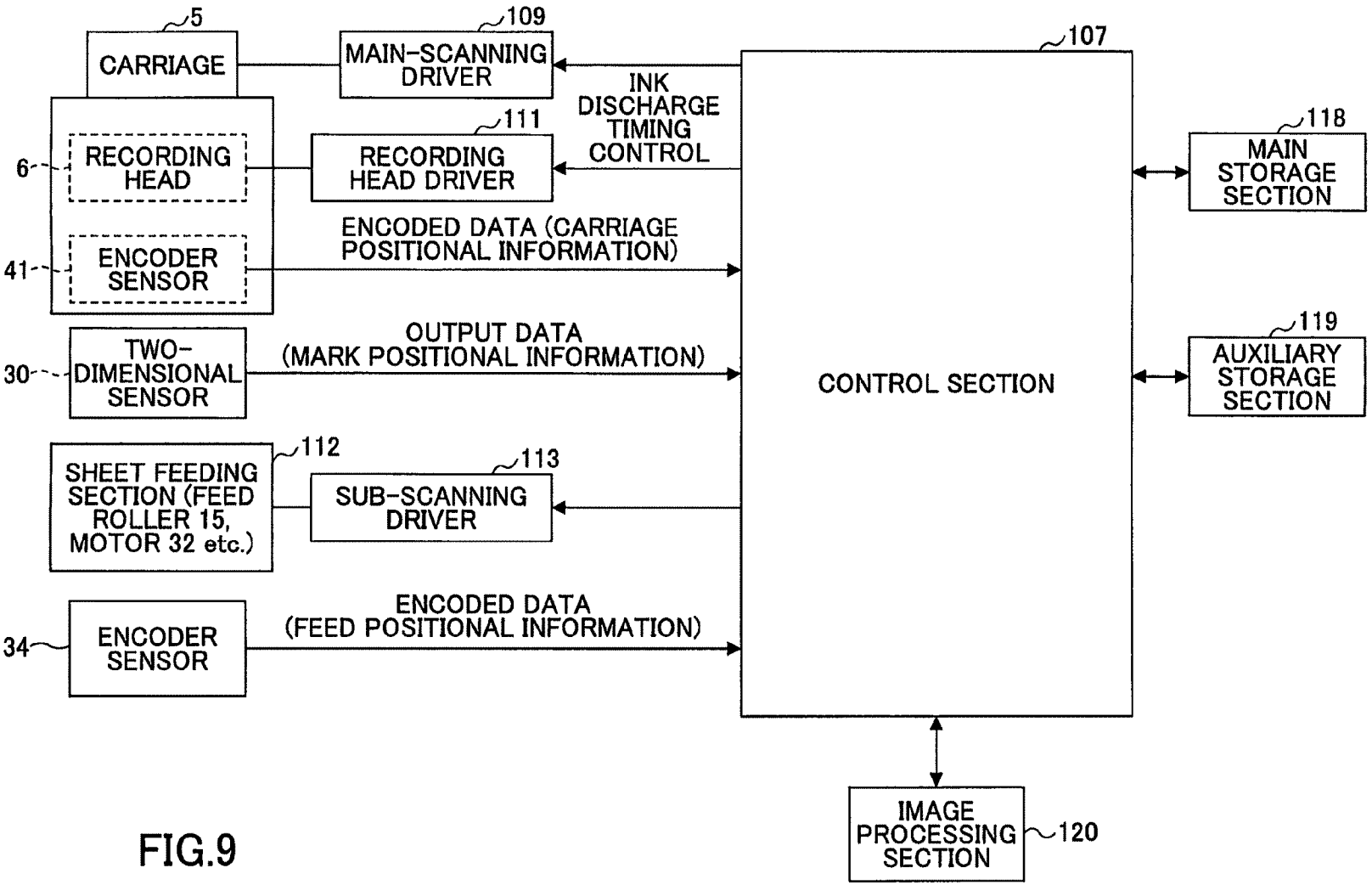
FIG. 9 is a drawing illustrating an exemplary configuration of a control mechanism of the recording apparatus.

As schematically illustrated in FIGS. 3 and 9, a feed control apparatus according to an embodiment of the present invention includes a feed roller 15 feeding a medium (a recording medium 16), a control unit (a control section 107) controlling the feed roller 15, a first detection unit (an encoder sensor 34) detecting a rotation position of the feed roller 15, and a sensor (a two-dimensional sensor 30). The two-dimensional sensor 30 detects plural marks 101 arranged on a test chart (test pattern) 100 when the test chart 100 is fed by the feed roller 15. The test chart 100 is used for adjusting (controlling the feeding amount (i.e., rotation) of the feed roller 15.

Figure 10:
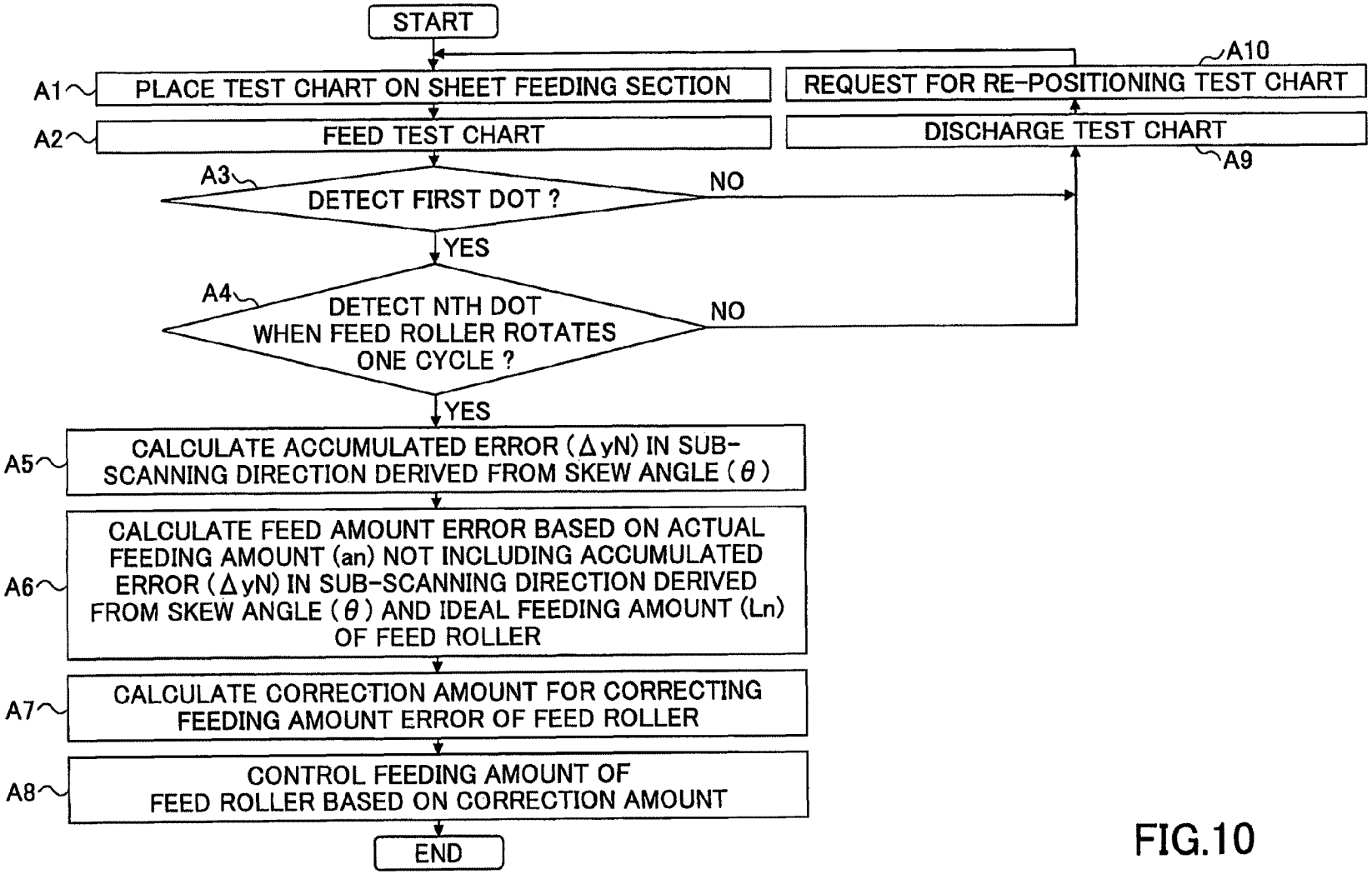
FIG. 10 is a flowchart illustrating an operational procedure executed by the recording apparatus.

As illustrated in step A5 in FIG. 10, the control unit (i.e., the control section 107) calculates a difference ($\Delta yN$) between a value "$\alpha$" ($\alpha$=(xN,yN) see FIG. 11) and a value "$\beta$" ($\beta$=(xN0, yN0) see FIG. 11), the value "$\alpha$" indicating actual positional information of Nth mark 101 (N: an arbitrary integer) actually detected by the two-dimensional sensor 30 when the feed roller 15 rotates one revolution (360 degrees), the value "$\beta$" indicating theoretical positional information of the Nth mark 101 ideally detected by the two-dimensional sensor 30 when the feed roller 15 rotates one revolution.

Figure 8A:
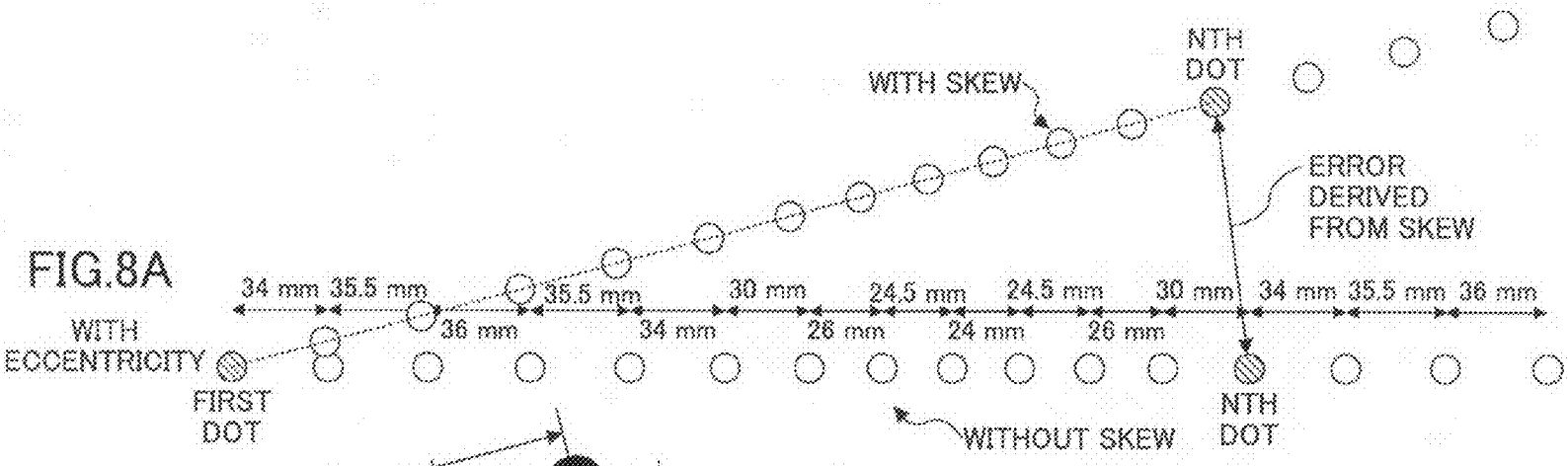
FIGS. 8A and 8B are drawings illustrating where the test data are skewed.

Next, based on the calculated difference ($\Delta yN$), correction feeding amounts (i.e., the positional information of the marks illustrated in FIG. 5B marked as "with eccentricity") of the marks 101 are calculated (obtained) based on the actual feeding amounts of the marks 101 illustrated in FIG. 8A obtained by detecting the marks 101 using the sensor 30.

Next, errors (feeding amount errors) between the calculated correction feeding amounts of the marks 101 (i.e., the positional information of the marks 101 illustrated in FIG. 5B marked as "with eccentricity") and the corresponding predetermined theoretical feeding amounts of the marks 101 (i.e., the positional information of the marks 101 illustrated in FIG. 5A marked as "without eccentricity") obtained by matching them to the corresponding to the rotational positions of the feed roller 15 (step A6 in FIG. 10).

Figure 6:
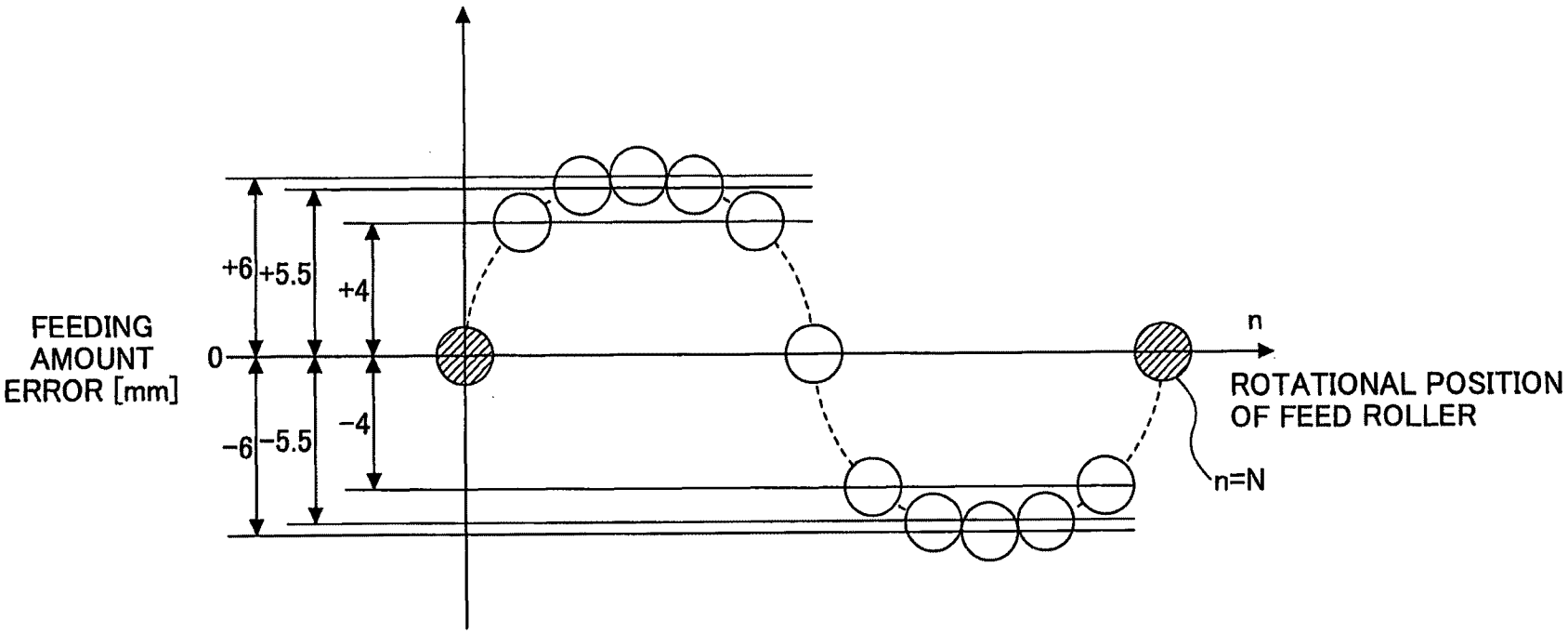
FIG. 6 is a drawing illustrating where the test data are not skewed.

Next, based on the relationship illustrated in FIG. 6 between the rotational positions of the feed roller 15 and the errors (feeding amount errors), correction amounts for correcting feeding amounts of feed roller 15 are calculated (step A7 in FIG. 10). Then, based on the calculated correction amounts, the feed amounts of the feed roller 15 are controlled (step A8 in FIG. 10).

By doing in this way, the feed control apparatus according to this embodiment of the present invention may reduce the variation of the feeding amounts of feed roller 15.

In the following, details of the feed control apparatus according to this embodiment of the present invention are described with reference to the accompanying drawings. Further, in the following description, it is assumed that the above-described feed control apparatus is included in a recording apparatus described below.

First Embodiment

Example of Schematic Mechanical Configuration of Recording Apparatus

First, a schematic configuration of a mechanical part of a recording apparatus according to an embodiment of the present invention is described with reference to FIG. 1.

Figure 1:
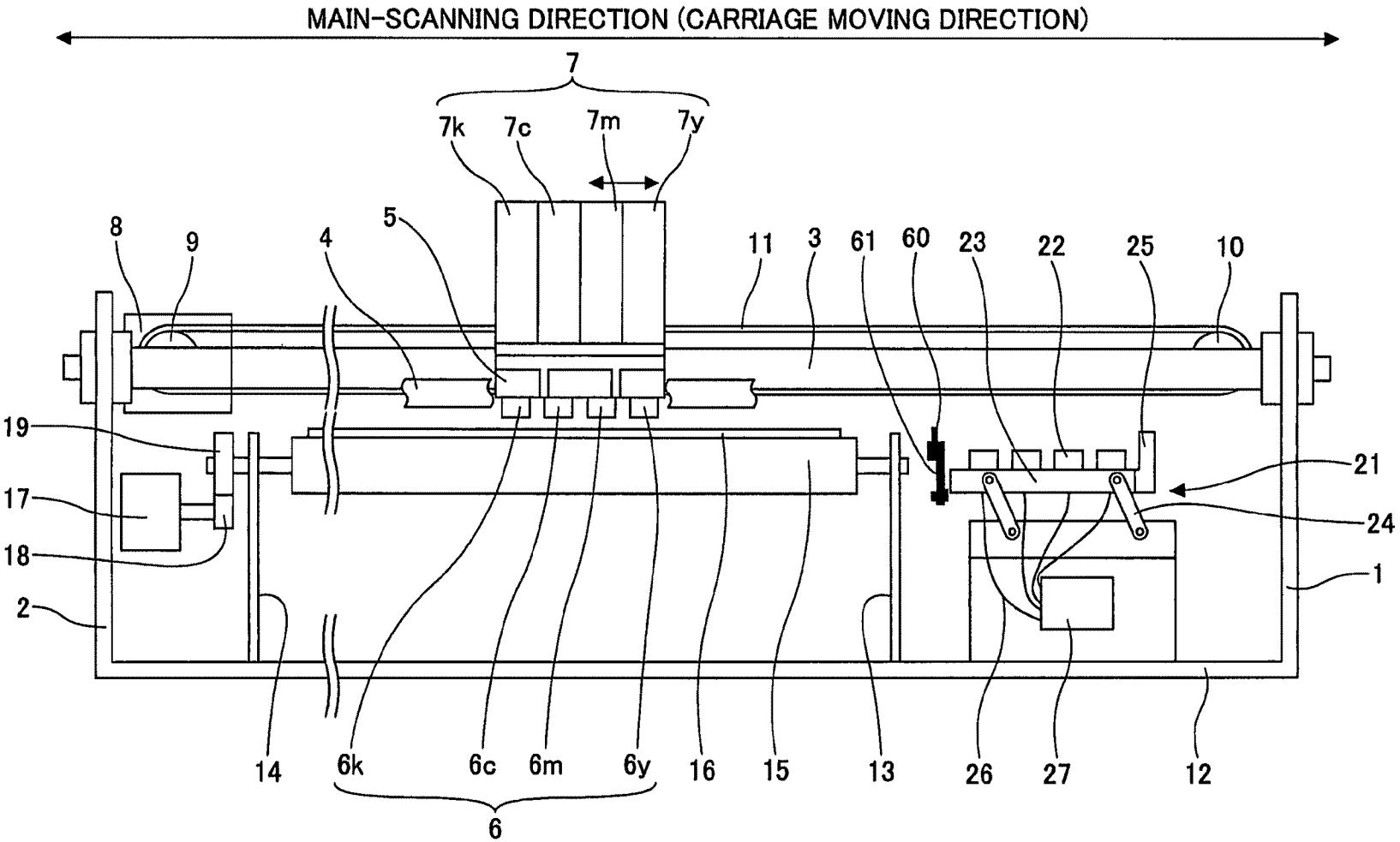
FIG. 1 is a schematic drawing illustrating a mechanical configuration of a recording apparatus according to an embodiment of the present invention.

As illustrated in FIG. 1, in a recording apparatus according to this embodiment of the present invention, a main supporting guide rod 3 and a sub supporting guide rod 4 are provided between side plates 1 and 2 and substantially horizontally installed. A carriage 5 is slidably supported by the main supporting guide rod 3 and the sub supporting guide rod 4 so that the carriage 5 can move in the main-scanning direction.

Further, there are four recording heads 6*y*, 6*m*, 6*c*, and 6*k* for discharging yellow (Y) ink, magenta (M) ink, cyan (C) ink, and black (Bk) ink, respectively, which are mounted on the carriage 5 in a manner such that the discharging surfaces of the recording heads 6 face downward. Hereinafter, any or all of the recording heads may be referred to as a "recording head 6". Further, four ink cartridges 7*y*, 7*m*, 7*c*, and 7*k* are detachably mounted on the recording head 6. Hereinafter, any or all of the ink cartridges may be referred to as an "ink cartridge 7". The ink cartridge 7 is an ink supply body that supplies each color ink to the corresponding recording head 6.

The carriage 5 is connected to a timing belt 11 stretched between a drive pulley 9 (drive timing pulley) and a driven pulley 10 (idler pulley), the drive pulley 9 being rotated by a main-scanning motor 8. By having this configuration, when the main-scanning motor 8 is driven and controlled, the carriage 5 can move in the main-scanning direction (carriage moving direction).

As illustrated in FIG. 3, an encoder sensor 41 is provided on the carriage 5, so that the encoder sensor 41 can detect marks on an encoder sheet 40. By detecting the marks on the encoder sheet 40 using the encoder sensor 41, encoded data are obtained. Based on the obtained encoded data, the movement of the carriage 5 in the main-scanning direction is controlled.

Further, as illustrated in FIG. 1, in the recording apparatus according to this embodiment of the present invention, sub frames 13 and 14 stand upright on a bottom plate 12 disposed between the side plates 1 and 2. The feed roller 15 is rotatably supported in a position sandwiched between the sub frames 13 and 14. A sub-scanning motor 17 is disposed on the sub-frame 14 side, so that the feed roller 15 is rotationally driven by the rotation of the sub-scanning motor 17. To transmit the rotation from the sub-scanning motor 17 to the feed roller 15, a gear 18 and a gear 19 meshed with the gear 18 are provided (used), the gear 18 being fixed to the rotation axis of the sub-scanning motor 17, the gear 19 being fixed to the rotation axis of the feed roller 15.

Further, a reliability maintenance and recovery mechanism (hereinafter referred to as a "sub system") 21 for maintaining and recovering the reliability of the recording head 6 is provided between the side plate 1 and the sub frame 13. The sub system 21 includes four cap members 22, a holder 23, and a link member 24. The cap members 22 cap the respective discharge surfaces of the recording head 6. The holder 23 holds the cap members 22. The link member 24 swingably supports the holder 23. By having this structure, when the carriage 5 is moved in the main-scanning direction and is in contact with an engage section 25 provided on the holder 23, the holder 23 is lifted up, so that the cap members 22 held by the holder 23 cap the respective discharge surfaces of the recording head 6. On the other hand, when the carriage 5 is required to separate from the engage section 25 to move to an area to perform a printing operation, the holder 23 is lowered so as to separate the cap members 22 from the discharge surfaces of the recording head 6.

Further, the cap members 22 are connected to a suction pump 27 via respective suction tubes 26, and serve as air communication ports to communicate with the atmosphere via an air communication tube and air communication valve. Further, the suction pump 27 is connected to a waste liquid storage tank (not shown) to discharge the suctioned waste liquid from the suction pump 27.

Further, a wiper blade 60 mounted on a blade arm 61 is disposed on one side of the holder 23. The blade arm 61 is swingably and pivotally supported so that the blade arm 61 can swing according to the rotation of a cam (not shown) rotated by a driving section (not shown).

In the recording apparatus according to this embodiment of the present invention as illustrated in FIG. 1, ink is discharged from the recording head 6 mounted on the carriage 5 while the carriage 5 moves in the main-scanning direction, so that the ink can be adhered onto a recording medium 16 to form an image (dots) on a line on the recording medium 16. Further, the recording medium 16 is moved in the sub-scanning direction (perpendicular to the carriage moving direction) by using the feed roller 15 and the like, so that the recording in the main-scanning direction is repeated to form an image on the recording medium 16.

However, it should be noted that when the recording medium 16 is fed by the rotation of the feed roller 15, there may arise a slight error in the feeding amount of the recording medium 16. As a result, a recording position on the recording medium (i.e., actual position on the recording medium 16 where the image (dot) is formed) may be shifted from the corresponding desired position (i.e., shifted from the position where the image (dot) is theoretically recorded on the recording medium 16 when no such error occurs).

Figure 2:
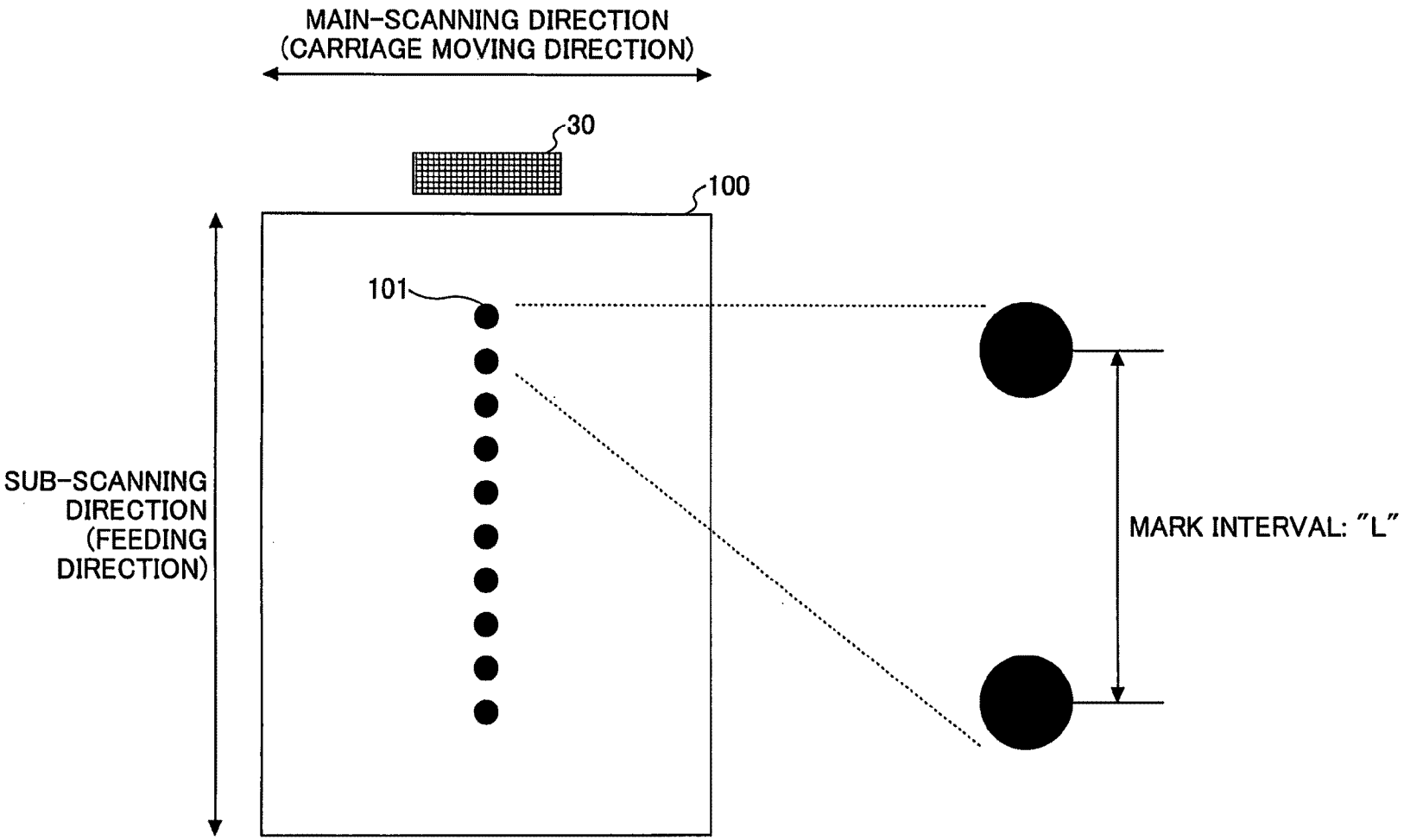
FIG. 2 is a drawing illustrating an exemplary test chart (test pattern) to be detected by a two-dimensional sensor.

To resolve the problem (i.e., the shift of the recording position), in the recording apparatus according to this embodiment of the present invention, a test chart (test pattern) 100 on which marks 101 are arranged at a predetermined pitch "L" as illustrated in FIG. 2 is provided and placed in a sheet feeding section (not shown) for storing accumulated recording media 16. Then, the test chart 100 is fed by the rotation of the feed roller 15, so that the marks 101 arranged on the test chart 100 are detected by the two-dimensional sensor 30. Next, based on the information obtained by detecting the marks 101, actual feeding amounts (actual feeding amounts by the feed roller 15) of the marks 101 are calculated. Then, differences (feeding amount errors) between the actual feeding amounts of the marks 101 and the corresponding predetermined theoretical feeding amounts (i.e., ideal feeding amounts by the feed roller 15) of the marks 101 are obtained by matching them to the respective rotational positions (rotational angles) of the feed roller 15. Next, based on the relationship between the rotational positions of the feed roller 15 and the corresponding differences (feeding amount errors), correction amounts for correcting the corresponding feeding amounts of the feed roller 15 are calculated, so that the feeding amount of the feed roller 15 is controlled by using the calculated correction amounts. By controlling the feeding amounts of the feed roller 15 in this way, it may become possible to reduce the variation of the feeding amounts of the feed roller 15 in the sub-scanning direction. Further, as illustrated in FIG. 2, the test chart (test pattern) 100 on which the marks (dots) are arranged at an equal interval (mark interval: "L") is used for adjusting (controlling) the feeding amounts of the feed roller 15.

Exemplary Configuration of Carriage and Surrounding of Carriage in Recording Apparatus Next, an exemplary configuration of the carriage 5 and the surroundings of the carriage 5 are described with reference to FIG. 3.

As illustrated in FIG. 3, the recording apparatus according to this embodiment of the present invention includes the carriage 5, the main supporting guide rod 3, a platen plate 31, the feed roller 15, a motor 32, an encoder wheel 33, an encoder sensor 34, and a sheet discharging section 50.

The sheet discharging section 50 discharges the recording medium 16 and the test chart 100 to the outside of the recording apparatus. In this embodiment, the sheet discharging section 50 includes the two-dimensional sensor 30. The two-dimensional sensor 30 detects the marks 101 arranged on the test chart 100, so as to obtain positional information (two-dimensional data) of the marks 101. By having the two-dimensional sensor 30 on the sheet discharging section 50, a detection error in detecting the marks 101 may be better controlled (reduced). It should be noted that the two-dimensional sensor 30 is not limited to a specific sensor as long as the two-dimensional sensor 30 can appropriately detect the marks 101 arranged on the test chart 100 and that any appropriate configuration and any appropriate detection method may alternatively be employed. Further, the position where the two-dimensional sensor 30 is to be disposed is not limited to the position described above. Namely, the two-dimensional sensor 30 may be disposed at any position as long as the two-dimensional sensor 30 can appropriately detect the marks 101 arranged on the test chart 100. For example, the two-dimensional sensor 30 may be integrally disposed on the carriage 5. Otherwise, the two-dimensional sensor 30 may be separately disposed from the carriage 5. In the case where the two-dimensional sensor 30 is mounted on the carriage 5, the position of the carriage 5 is required to be controlled so that the two-dimensional sensor 30 can successfully detect the marks 101 on the test chart 100.

As described above, the carriage 5 includes the encoder sensor 41. The encoder sensor 41 is used to control the movement of the carriage 5 in the main-scanning direction based on the encoded data obtained by detecting the marks on the encoder sheet 40.

Further, the platen plate 31 is a supporting member for supporting the recording medium 16 fed by the feed roller 15.

The feed roller 15, the motor 32, the encoder wheel 33, and the encoder sensor 34 are provided (used) for controlling the feeding of the recording medium 16 and the test chart 100.

Figure 4:
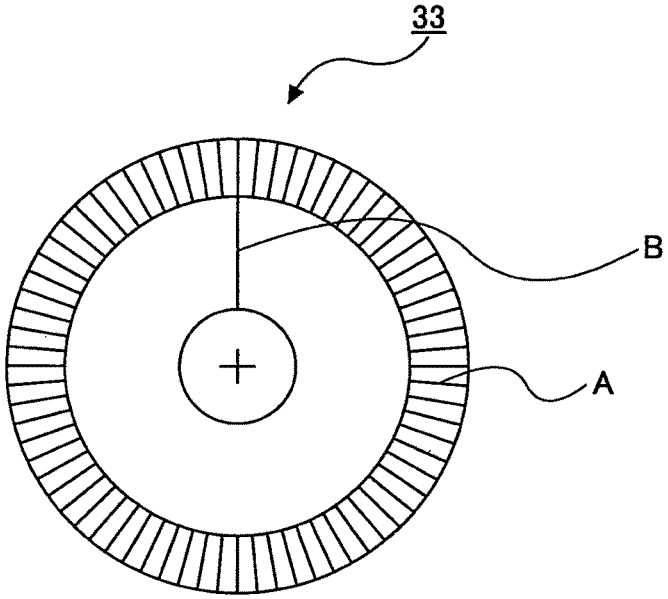
FIG. 4 is a drawing illustrating an exemplary encoder wheel.

FIG. 4 illustrates the encoder wheel 33. As illustrated in FIG. 4, to measure the feeding amount of the feed roller 15, a pattern A and a pattern B are formed (arranged) on the encoder wheel 33. Preferably, the pattern A includes plural marks (slits or the like) arranged at equal pitches along the circumference part of the encoder wheel 33. Further, preferably, pattern B is a single slot (mark) including one slot (mark) of the pattern A having longer length than that of the mark of the pattern A, so that the slot (mark) of the pattern B can be used (detected) to determined the home position (HP) of the feed roller 15. The encoder sensor 34 detects each of the slots (marks) of the pattern A and the slot (mark) of the pattern B, so as to obtain the encoded data of the pattern A and the pattern B.

In the recording apparatus in this embodiment, when the test chart 100 is fed in the sub-scanning direction (feeding direction) by the feed roller 15, the marks 101 arranged on the test chart 100 are detected using the two-dimensional sensor 30, and actual feeding amounts of the marks are calculated. Further, based on the encoded data detected by the encoder sensor 34 when the two-dimensional sensor 30 detects the marks 101, the corresponding rotational positions (rotational angles) of the feed roller 15 are calculated (determined). For example, a case is described where the encoder sensor 34 has counted 38,400 counts while the feed roller 15 rotates one revolution (360 degrees). In this case, the encoded data per one rotational angle (1 degree) of the feed roller 15 is given as 38,400/360≈107 (counts). Therefore, for example, when the encoded data obtained by the encoder sensor 34 is 3,840 (counts), the rotational position (rotational angle) of the feed roller 15 is given as 3,840/107≈74.8 (counts).

Positional Information of Marks 101

Next, the positional information of the marks 101 is described with reference to FIGS. 5A through 8B.

Case where Test Chart is not Skewed

First, a case is described where the test chart 100 is not skewed with reference to FIGS. 5A through 6. In this case, it is assumed that the marks 101 on the test chart 100 are arranged at equal intervals ("mark distance (L)") 30 mm. (When the test chart 100 is skewed, the marks 101 are detected as being shifted in the main-scanning direction as schematically illustrated in FIG. 8.)

FIG. 5A illustrates a case where the test chart 100 is not skewed (i.e. when the test chart 100 is not shifted in the main-scanning direction as illustrated in FIG. 5C) and the a feeding state of the feed roller 15 is ideal (i.e., there is no variation in the feeding amount of the feed roller 15 due to there being no positioning error of the feed roller 15, the shape of the feed roller 15 being a true circle and the like). In this case, as illustrated in FIG. 5A marked as "without eccentricity", the positional information of the marks 101 determined by detecting the marks 101 using the two-dimensional sensor 30 is that the marks are arranged at equal distance (mark distance: L=30 mm). Namely, FIG. 5A (marked as "without eccentricity") shows where the feeding amounts of the marks 101 are theoretically ideal (ideally detected) (i.e., FIG. 5A shows the ideal feeding amounts of the ideal feed roller 15). The ideal feeding amounts are recorded in a memory or the like so that the recording apparatus can use the ideal feeding amounts.

On the other hand, FIG. 5B illustrates a case where the test chart 100 is not skewed but the feeding state of the feed roller 15 is not ideal (i.e., there is variation observed in the feeding amount of the feed roller 15 due to a positioning error of the feed roller 15, the shape of the feed roller 15 being not a true circle or the like). In this case, as illustrated in FIG. 5B marked as "with eccentricity", the positional information of the marks 101 determined by detecting the marks 101 using the two-dimensional sensor 30 is that the pitches between the marks vary (in the case of FIG. 5B, the mark distance "L" varies in a range from 24 mm to 36 mm). Namely, FIG. 5B (marked as "with eccentricity") shows actual feeding amounts of the marks 101 (i.e., FIG. 5B shows the actual feeding amounts of the feed roller 15) calculated (obtained) based on the data obtained by detecting the marks 101 using the two-dimensional sensor 30.

When the actual feeding amounts of the marks 101 vary in response to the actual rotational positions (rotational angles) of the feed roller 15, differences (feeding amount differences) between the actual feeding amounts of the marks 101 as illustrated in FIG. 5B ("with eccentricity") and the respective ideal (i.e., "theoretical") feeding amounts of the marks 101 as illustrated in FIG. 5A ("without eccentricity") are obtained by matching them to the corresponding rotational positions (rotational angles) of the feed roller 15. Then, the relationship between the differences (the feeding amount differences) and the rotational positions (rotational angles) of the feed roller 15 is approximated to a sine waveform as illustrated in FIG. 6. Based on the relationship as illustrated in FIG. 6, correction amounts (feeding amount errors) which are to be used for correcting feeding amounts of the feed roller 15 are calculated. Then, the calculated correction amounts (feeding amount errors) are used to correct (control) the feeding amounts of the feed roller 15.

Case where Test Chart is Skewed

Next, a case is described where the test chart 100 is skewed with reference to FIGS. 7A through 8B.

Figure 8B:
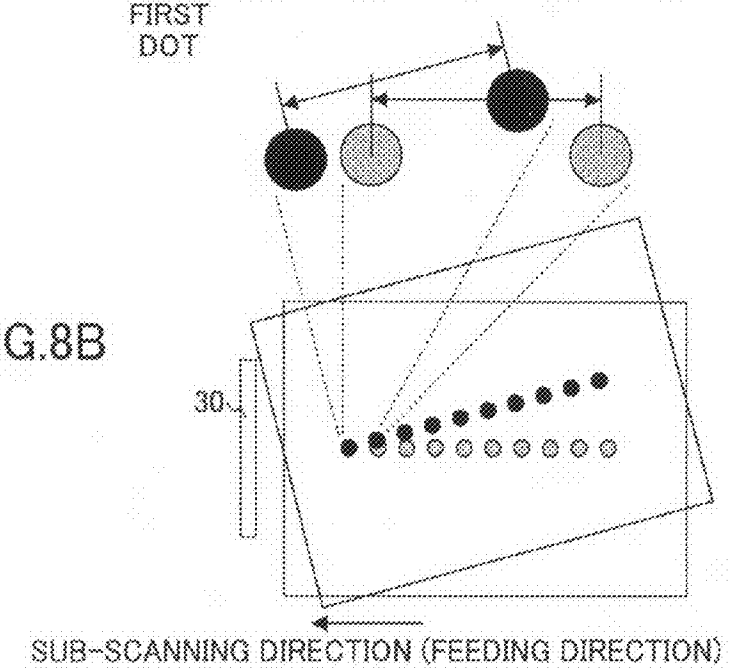

When the test chart 100 is placed on a sheet feeding section (not shown), the test chart 100 may be skewed (i.e., the test chart 100 may be positioned in an inclined (skewed) manner) as illustrated in FIGS. 7B and 8B. When the feed roller 15 starts feeding the "skewed" test chart 100, the positional information of the marks 101 obtained by detecting the marks 101 using the two-dimensional sensor 30 are accordingly inclined (skewed) as illustrated in FIGS. 7A and 8A.

FIG. 7A shows the positional information of the marks 101 obtained by detecting the marks 101 on the test chart 100 using the two-dimensional sensor 30 when the feeding state of the feed roller 15 is ideal but the test chart 100 is skewed. On the other hand, FIG. 8A shows the positional information of the marks 101 obtained by detecting the marks 101 on the test chart 100 using the two-dimensional sensor 30 when the feeding state of the feed roller 15 is not ideal (i.e., the eccentricity is observed) and the test chart 100 is skewed.

As schematically illustrated in FIGS. 7A and 8A, the positional information of the marks 101 which have been obtained by detecting the marks 101 on the "skewed" test chart 100 may include errors derived from the skew component (skew angle (θ)); and which may prevent accurate calculation of the correction amounts (feeding amount errors) for correcting feeding amounts of the feed roller 15.

To resolve the problem, in the recording apparatus according to this embodiment of the present invention, the errors derived from the skew component (skew angle (θ)) are removed from the positional information of the marks 101 obtained by detecting the marks 101 on the "skewed" test chart 100 using the two-dimensional sensor 30. By removing the errors derived from the skew component (skew angle (θ)), such positional information of the marks 101 as illustrated in FIG. 5B marked as "with eccentricity" may be obtained.

Then, the differences (feeding amount differences) between the actual feeding amounts of the marks 101 as illustrated in FIG. 5B ("with eccentricity") and the respective ideal (i.e., "theoretical") feeding amounts of the marks 101 as illustrated in FIG. 5A ("without eccentricity") are obtained by matching them to the corresponding rotational positions (rotational angles) of the feed roller 15. Then, the relationship between the differences (the feeding amount differences) and the rotational positions (rotational angles) of the feed roller 15 is approximated to a sine waveform as illustrated in FIG. 6. Based on the relationship between the differences (the feeding amount differences) and the rotational positions (rotational angles) of the feed roller 15 as illustrated in FIG. 6, the correction amounts (feeding amount errors) which are to be used for correcting feeding amounts of the feed roller 15 are calculated. Then, the calculated correction amounts (feeding amount errors) are used to correct (control) the feeding amounts of the feed roller 15.

Next, an exemplary configuration of a control mechanism of the recording apparatus according to this embodiment of the present invention is described with reference to FIG. 9.

As illustrated in FIG. 9, the control mechanism of the recording apparatus according to this embodiment of the present invention includes the control section 107, a main storage section 118, an auxiliary storage section 119, the carriage 5, a main-scanning driver 109, the recording head 6, a recording head driver 111, the encoder sensor 41, the two-dimensional sensor 30, a sheet feeding section 112, the encoder sensor 34, a sub-scanning driver 113, and an image processing section 120.

The control section 107 supplies recorded data and drive control signals (pulse signals) to the main storage section 118 and the respective drivers so as to control the entire recording apparatus. Further, the control section 107 controls the driving (movement) of the carriage 5 in the main-scanning direction via the main-scanning driver 109. Further, the control section 107 controls the discharge timing of ink via the recording head driver 111. Further, the control section 107 controls the driving of the sheet feeding section 112 (e.g., feed roller 15 and motor 32) in the sub-scanning direction via the sub-scanning driver 113.

The encoder sensor 41 detects the marks on the encoder sheet 40, and outputs the encoded data obtained by detecting the marks on the encoder sheet 40 to the control section 107. Based on the encoded data, the control section 107 controls the driving of the carriage 5 in the main-scanning direction via the main-scanning driver 109.

The encoder sensor 34 detects the marks of the patterns A and B formed on the encoder wheel 33, and outputs the encoded data obtained by detecting the marks of the patterns A and B to the control section 107. Based on the encoded data, the control section 107 controls the driving of the sheet feeding section 112 in the sub-scanning direction via the sub-scanning driver 113.

The two-dimensional sensor 30 detects the marks 101 arranged on the test chart 100, and outputs the data (output data) obtained by detecting the marks 101 to the control section 107. Based on the output data from the two-dimensional sensor 30, the control section 107 associates and stores the positional information of the marks 101 with the corresponding encoded data detected by the encoder sensor 34 when the marks 101 are detected by the two-dimensional sensor 30 into the main storage section 118.

The main storage section 118 stores necessary information. For example, the main storage section 118 stores a program of a processing procedure to be executed by the control section 107. Herein, it is assumed that the data in the main storage section 118 can be overwritten by, for example, an external apparatus. The auxiliary storage section 119 is used as a working memory.

The control section 107 of the recording apparatus according to this embodiment of the present invention reads image information from the image processing section 120 in accordance with a selected print mode, and converts the format of the read image information into a format for the recording head 6 in the auxiliary storage section 119. Then, the control section 107 transmits the converted image information having the format for the recording head 6 to the recording head driver 111. The recording head driver 111 generates various timing signals based on the selected print modes for driving the recording head 6, and transmits the various timing signals for driving the recording head 6 and the image information to the recording head 6 to perform a printing process.

Further, the control section 107 controls the driving (movement) of the carriage 5 in the main-scanning direction via the main-scanning driver 109 in accordance with the selected print mode, and further controls the driving of the of the sheet feeding section 112 in the sub-scanning direction via the sub-scanning driver 113, so as to perform the printing operation.

Exemplary Processing Operation of Recording Apparatus

Next, a series of processing operations in the recording apparatus according to this embodiment of the present invention is described with reference to a flowchart of FIG. 10.

As illustrated in FIG. 10, the test chart 100 is placed on a sheet feeding section (not shown) (step A1). Then, the control section 107 controls the driving of the sheet feeding section 112 (e.g., feed roller 15 and motor 32) in the sub-scanning direction via the sub-scanning driver 113 to feed the test chart 100 in the sub-scanning direction (feeding direction) using the feed roller 15 (step A2).

Next, the first mark (dot) 101 on the test chart 100 is detected by the two-dimensional sensor 30. Then, the control section 107 stores the positional information (x1, y1) detected by the two-dimensional sensor 30 into the main storage section 118 (step A3).

After the first mark (dot) 101 is detected by the two-dimensional sensor 30, the marks (dots) 101 (i.e., from the second mark (dot) to the Nth mark (dot)) on the test chart 100 are detected using the two-dimensional sensor 30 until the feed roller 15 rotates one revolution. The control section 107 stores the positional information of the marks (dots) 101 from the second mark (dot) to the Nth mark (dot) detected by the two-dimensional sensor 30 into the main storage section 118 (step A4). Herein, the term "Nth mark (dot)" refers to the mark (dot) which is actually detected by the two-dimensional sensor 30 when the feed roller 15 rotates one revolution (n=N). By doing in this way, as a result, the positional information of the "nth" marks (dots) 101 (n=1 through N) is stored in the main storage section 118.

In a case where a skew amount (i.e., the skew angle (θ) of the test chart 100 is too large, the area of the marks 101 may exceed the area that can be detected (covered) by the two-dimensional sensor 30. Namely, in this case, the two-dimensional sensor 30 may not detect all the marks (dots) 101 on the test chart 100). To respond to this case, when the first mark (dot) 101 or the Nth mark (dot) 101 to be present (detected) until the feed roller rotates one revolution cannot be detected by the two-dimensional sensor 30 (NO in steps A3 or A4, respectively), the test chart 100 is discharged from the sheet discharging section 50 (step A9). Then, a request for properly positioning the test chart is sent to a user, prompting the user to re-position the test chart 100 on the sheet feeding section in a good manner (i.e., without being skewed) (step A10). As a method of requesting for properly re-positioning the test chart 100 on the sheet feeding section, for example, a method using a voice message, a character message or the like may be used.

On the other hand, when the Nth mark (dot) 101 to be present (detected) when the feed roller rotates one revolution is detected by the two-dimensional sensor 30 (YES in steps A4), the accumulated error (ΔyN) in the sub-scanning direction is calculated, the accumulated error (ΔyN) being derived from the skew component (skew angle (θ)) and having been accumulated until the Nth mark (dot) 101 (step A5).

Figure 11A:
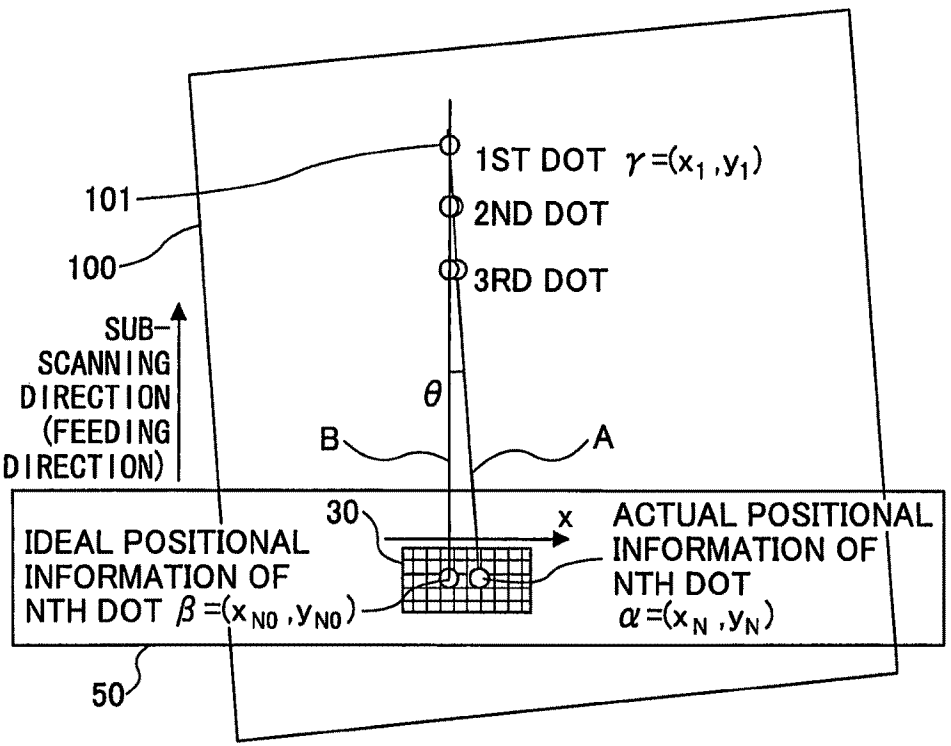
FIGS. 11A and 11B are drawings illustrating an accumulated error ($\Delta yN$) in the sub-scanning direction due to a skew angle ($\theta$)
Figure 12:
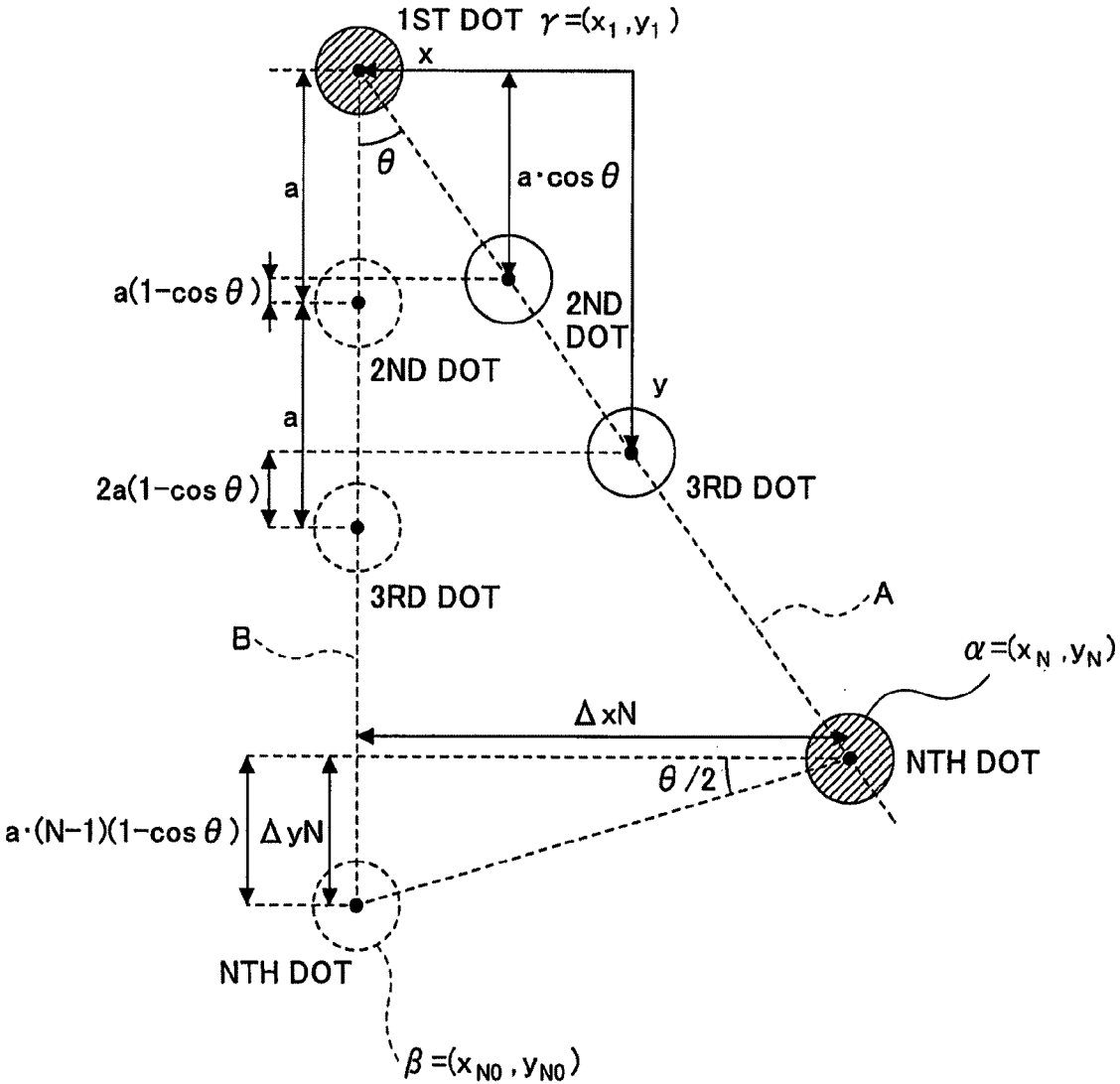
FIG. 12 is a drawing illustrating the accumulated error ($\Delta yN$) in the sub-scanning direction due to the skew angle ($\theta$)

Herein, the skew angle (θ) is an angle between the straight line A and the straight line B as illustrated in FIGS. 11A and 12.

Figure 11B:
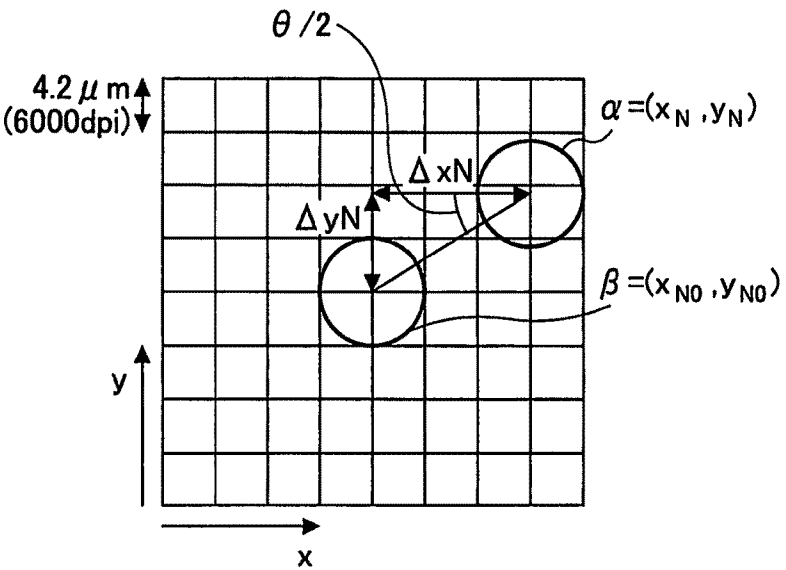

FIG. 11A schematically illustrates a relationship between the positional information ($\alpha=(x_N,y_N)$) of the Nth mark (dot) 101 actually detected by the two-dimensional sensor 30 when the feed roller 15 rotates one revolution and the (theoretical) positional information ($\beta=(x_{N0},y_{N0})$) of the Nth mark (dot) 101 ideally detected by the two-dimensional sensor 30 when the feed roller 15 rotates one revolution. FIG. 11B illustrates enlarged area including the positional information ($\alpha=(x_N, y_N)$) and the positional information ($\beta=(x_{N0}, y_{N0})$). FIG. 12 illustrates the accumulated error (ΔyN) in the sub-scanning direction, the accumulated error (ΔyN) being derived from the skew component (skew angle (θ)). Herein, the term "the positional information ($\beta=(x_{N0},y_{N0})$) of the Nth mark (dot) 101 ideally detected by the two-dimensional sensor 30" refers to the positional information obtained by detecting the Nth mark (dot) 101 using the two-dimensional sensor 30 when the a feeding state of the feed roller 15 is ideal (namely there is no variation in the feeding amount of the feed roller 15 due to no positioning error of the feed roller 15, the shape of the feed roller 15 being a true circle and the like) and the test chart 100 is not skewed (i.e. the test chart 100 is not shifted in the main-scanning direction as illustrated in the inclined (skewed) line of FIG. 8A and the like).

In FIG. 12, the straight line A passes through a point representing the positional information ($y=(x_1,y_1)$) of the first mark (dot) 101 actually detected by the two-dimensional sensor 30 and a point representing the positional information ($\alpha=(x_N,y_N)$) of the Nth mark (dot) 101 actually detected by the two-dimensional sensor 30 when the feed roller 15 rotates one revolution from the point representing the positional information ($\gamma=(x_1,y_1)$) of the first mark (dot) 101.

On the other hand, the straight line B in FIG. 12 passes through the point representing the positional information ($\gamma=(x_1,y_1)$) of the first mark (dot) 101 actually detected by the two-dimensional sensor 30 and a point representing the positional information ($\beta=(x_{N0},y_{N0})$) of the Nth mark (dot) 101 ideally detected by the two-dimensional sensor 30 when the feed roller 15 rotates one revolution from the point representing the positional information ($\gamma=(x_1,y_1)$) of the first mark (dot) 101.

Therefore, the skew angle (θ) between the straight line A and the straight line B is given by using a skew angle (θ/2) as follows:

$$\mathrm{Cos}\cdot(\theta/2)=(\Delta xN/(\Delta xN^2+\Delta yN^2)^{1/2})$$

$$\theta/2=\mathrm{Cos}^{-1}\cdot(\Delta xN/(\Delta xN^2+\Delta yN^2)^{1/2})$$

$$\theta=2\cdot\mathrm{Cos}^{-1}\cdot(\Delta xN/(\Delta xN^2+\Delta yN^2)^{1/2})$$

In the above equations, the symbol "ΔxN" denotes a difference ($|x_{N0}-x_N|$) between the positional information ($x_N$) in the x direction (main-scanning direction) of the Nth mark (dot) 101 actually detected by the two-dimensional sensor 30 when the feed roller 15 rotates one revolution and the positional information ($x_{N0}$) in the x direction of the Nth mark (dot) 101 ideally detected by the two-dimensional sensor 30 when the feed roller 15 rotates one revolution.

On the other hand, the symbol "ΔyN" denotes a difference ($\Delta y_{N0}-y_N|$) between the positional information ($y_N$) in the y direction (sub-scanning direction) of the Nth mark (dot) 101 actually detected by the two-dimensional sensor 30 when the feed roller 15 rotates one revolution and the positional information ($y_{N0}$) in the y direction of the Nth mark (dot) 101 ideally detected by the two-dimensional sensor 30 when the feed roller 15 rotates one revolution.

Therefore, based on the positional information ($y_N$) in the y direction (sub-scanning direction) of the Nth mark (dot) 101 actually detected by the two-dimensional sensor 30 when the feed roller 15 rotates one revolution and the positional information ($y_{N0}$) in the y direction of the Nth mark (dot) 101 ideally detected by the two-dimensional sensor 30 when the feed roller 15 rotates one revolution, it may become possible for the control section 107 to calculate the accumulated error ($\Delta yN=|y_{N0}-y_N|$) in the sub-scanning direction, the accumulated error ($\Delta yN=|y_{N0}-y_N|$) being derived from the skew component (skew angle (θ)) and having been accumulated until the Nth mark (dot) 101 is detected.

Further, the accumulated error (Δyn) in the sub-scanning direction may be expressed by the following formula, the accumulated error (Δyn) being derived from the skew component (skew angle (θ)) and having been accumulated when the nth mark (dot) 101 is detected.

$$\Delta yn=L\cdot(n-1)\cdot(1-\cos\theta)$$

Here, the symbol "L" denotes a distance between the adjacent marks (dots) 101, and the symbol "n" denotes the number of marks (dots) ranging from 1 through N, and the symbol "N" demotes the number of the mark (dot) 101 actually detected by the two-dimensional sensor 30 when the feed roller 15 rotates one revolution.

For example, when assuming that "L=a" as illustrated in FIG. 12, the accumulated error (Δy2) accumulated in the sub-scanning direction until the second mark (dot) 101 is detected is given as Δy2=a·(1−cos θ). In the same manner, the accumulated error (Δy3) accumulated in the sub-scanning direction until the third mark (dot) 101 is detected is given as Δy2=2a·(1−cos θ). Further, the accumulated error (ΔyN) accumulated in the sub-scanning direction until the Nth mark (dot) 101 which is actually detected when the feed roller 15 rotates one revolution is given as ΔyN=a·(N−1)·(1−cos θ).

Therefore, based on the actual feeding amounts "an" of an nth mark (dot) 101 after removing the accumulated error (Δyn) in the sub-scanning direction, the accumulated error (Δyn) being derived from the skew angle (θ) (i.e., the actual feeding amounts of the feed roller 15) and the corresponding predetermined theoretical feeding amounts "Ln" (i.e., ideal feeding amounts of the feed roller 15), it may become possible to calculate the feeding amount error "ye n" of the feed roller 15 (step A6).

The actual feeding amounts "an" of the nth mark (dot) 101 after removing the accumulated error (Δyn) in the sub-scanning direction derived from the skew angle (θ) (i.e., the actual feeding amounts of the feed roller 15) is given in the following equation.

$$An=yn-\Delta yn$$

Here, the symbol "yn" denotes the actual feeding amounts of the nth mark (dot) 101 including the accumulated error (Δyn) in the sub-scanning direction derived from the skew angle (θ). Further, the symbols "yn" further denotes the positional information of the nth mark (dot) 101 obtained by actually detecting the nth mark (dot) 101 using the two-dimensional sensor 30. Further, the symbol "n" refers to the number of marks (dots), ranging between 1 and N (n=1 through N).

For example, the feeding amount (a2) until the second mark (dot) 101 is given as a2=y2−Δy2. In the same manner, the feeding amount (a3) until the third mark (dot) 101 is given as a3=y3−Δy3. Further, the feeding amount (aN) until the Nth mark (dot) 101 is actually detected when the feed roller 15 rotates one revolution is given as aN=yN−ΔyN.

Therefore, the feeding amount error "ye n" of the feed roller 15 at the Nth mark (dot) 101 is given as follows:

The feeding amount error "ye n" of the feed roller 15 at the Nth mark (dot) 101: "ye n"=an−Ln Here, the symbol "L" denotes the distance between the adjacent marks (dots) 101, and the symbol "n" denotes the number of marks (dots) ranging from 1 to N (N=1 through N).

Further, when there is the accumulated error (Δyn) in the sub-scanning direction derived from the skew angle (θ), it may become possible to obtain the differences (feeding amount errors) ("ye n"+Δyn) between the actual feeding amounts (yn=an+Δyn) of the marks (dots) 101 and the corresponding predetermined theoretical feeding amounts "Ln" by matching them to the corresponding rotational positions (rotational angles) of the feed roller 15. Further, it may become possible to approximate the relationship between the rotational positions (rotational angles) of the feed roller 15 and the differences (the feeding amount errors) ("ye n"+Δyn) to a sine waveform as illustrated in FIG. 13.

Figure 13:
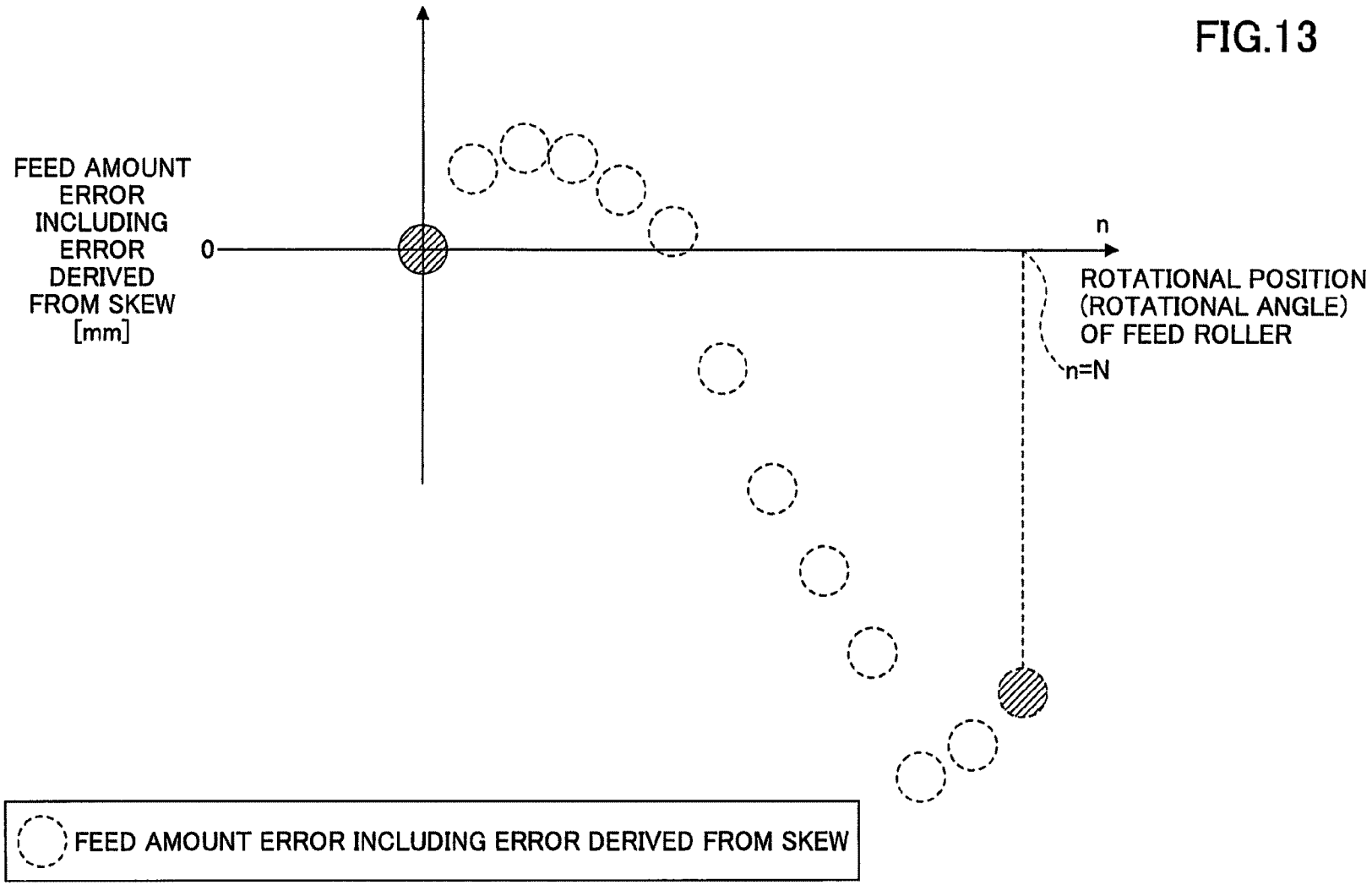
FIG. 13 is a drawing illustrating a feeding amount error including an error component derived from the skew angle ($\theta$)

However, as illustrated in FIG. 13, when the correction amounts (feeding amount errors) to be used for correcting feeding amounts of the feed roller 15 are calculated based on the correction amounts (feeding amount errors) ("ye n"+Δyn) which include the accumulated errors (Δyn) in the sub-scanning direction derived from the skew angle (θ), and even if the feeding amounts of the feed roller 15 are controlled using the calculated correction amounts (feeding amount errors), erroneous correction may be performed; and as a result, it may not be possible to adequately reduce the variation of the feeding amounts of the feed roller 15 in the sub-scanning direction.

Figure 14:
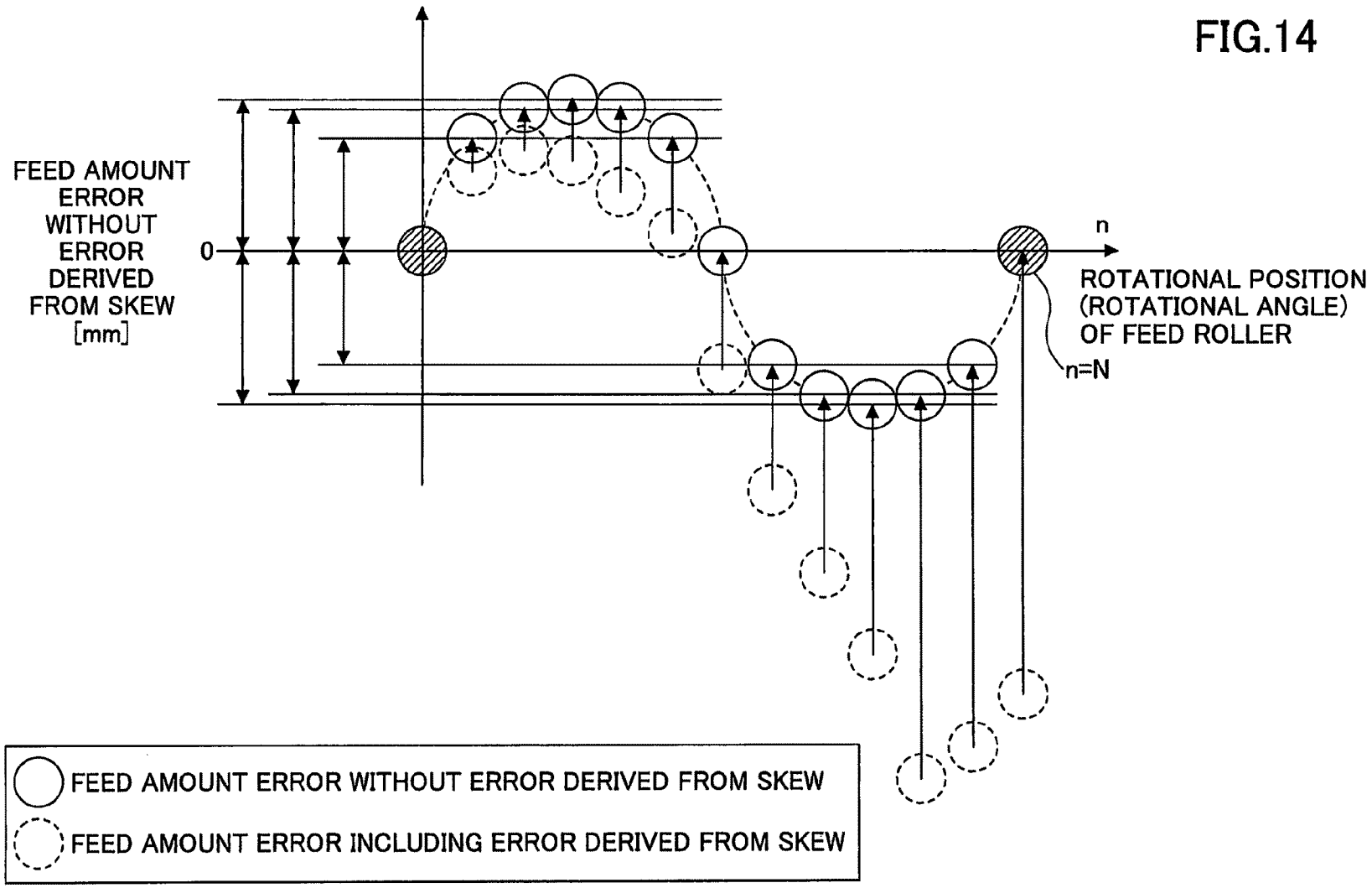
FIG. 14 is a drawing illustrating a feeding amount error excluding the error component derived from the skew angle ($\theta$)

To resolve the problem, according to this embodiment of the present invention, the accumulated error (Δyn) in the sub-scanning direction derived from the skew angle (θ) is removed from the actual feeding amounts (yn=an+Δyn) of the nth mark (dot) 101, so that the actual feeding amounts "an" including the errors derived from the eccentricity component only may be calculated (obtained). Further, the differences (feeding amount errors) ("ye n") between the actual feeding amounts (an) of the nth mark (dot) 101 including the errors derived from the eccentricity component only and the corresponding predetermined theoretical feeding amounts "Ln" of the nth mark (dot) 101 are obtained by matching them to the corresponding rotational positions (rotational angles) of the feed roller 15. Further, the relationship between the rotational positions (rotational angles) of the feed roller 15 and the differences (the feeding amount errors) ("ye n") is approximated to a sine waveform as illustrated in FIG. 14. Further, the correction amounts (feeding amount errors) to be used for correcting feeding amounts of the feed roller 15 are calculated based on the relationship between the rotational positions (rotational angles) of the feed roller 15 and the differences (the feeding amount errors) ("ye n") as illustrated in FIG. 14 (step A7). Then, based on the calculated correction amounts (feeding amount errors), the feeding amounts of the feed roller 15 is controlled (step S8). By doing in this way, it may become possible to prevent erroneous correction, thereby enabling appropriately reducing the variation of the feeding amounts of the feed roller 15 in the sub-scanning direction.

Example of Method of Removing Accumulated Error Derived from the Skew Angle (θ)

Figure 15:
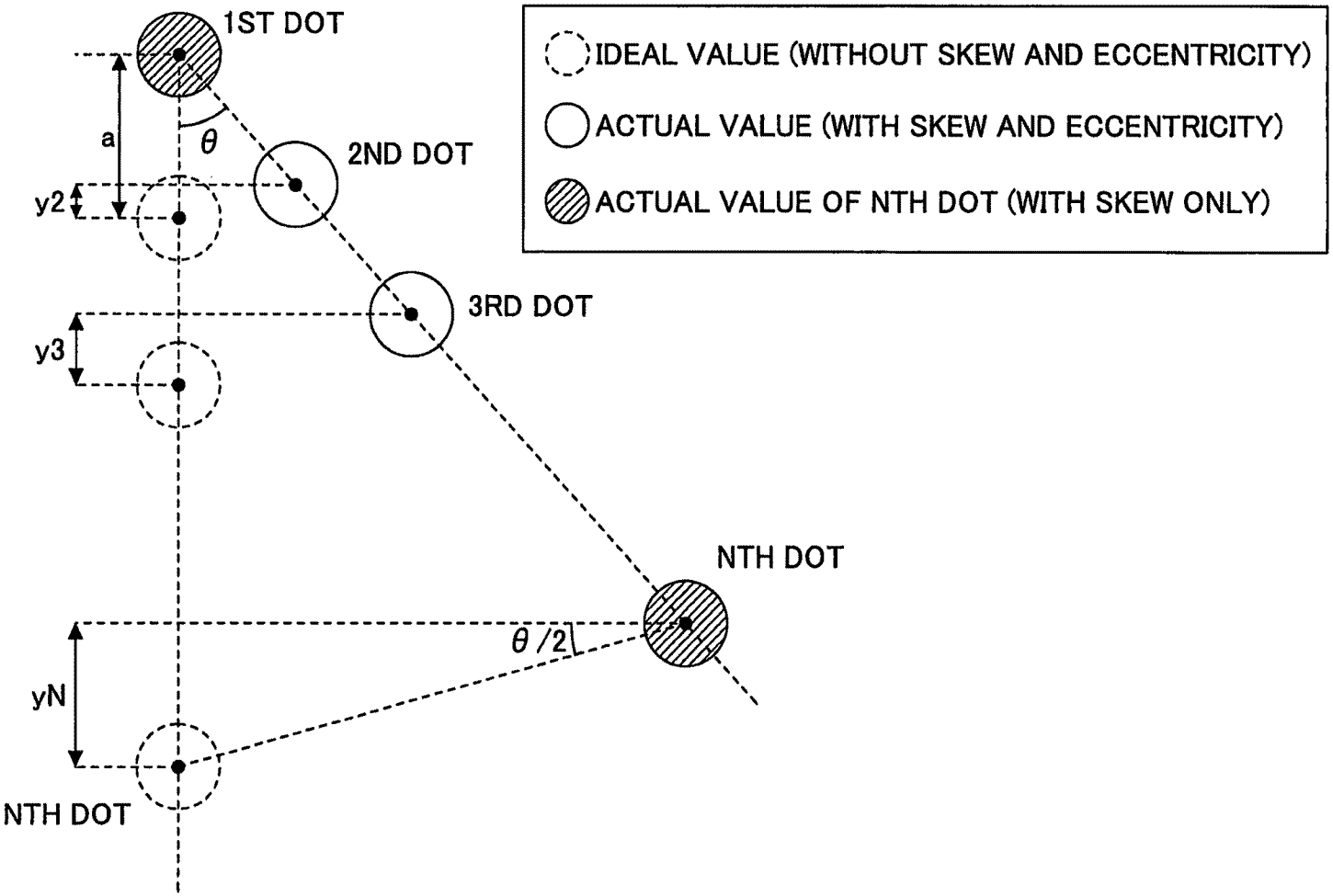
FIG. 15 is a drawing illustrating a relationship between ideal positional information of marks in an ideal state (where neither skew nor eccentricity is observed) and actual positional information of the marks actually measured under a state where both skew and eccentricity are observed.
Figure 16:
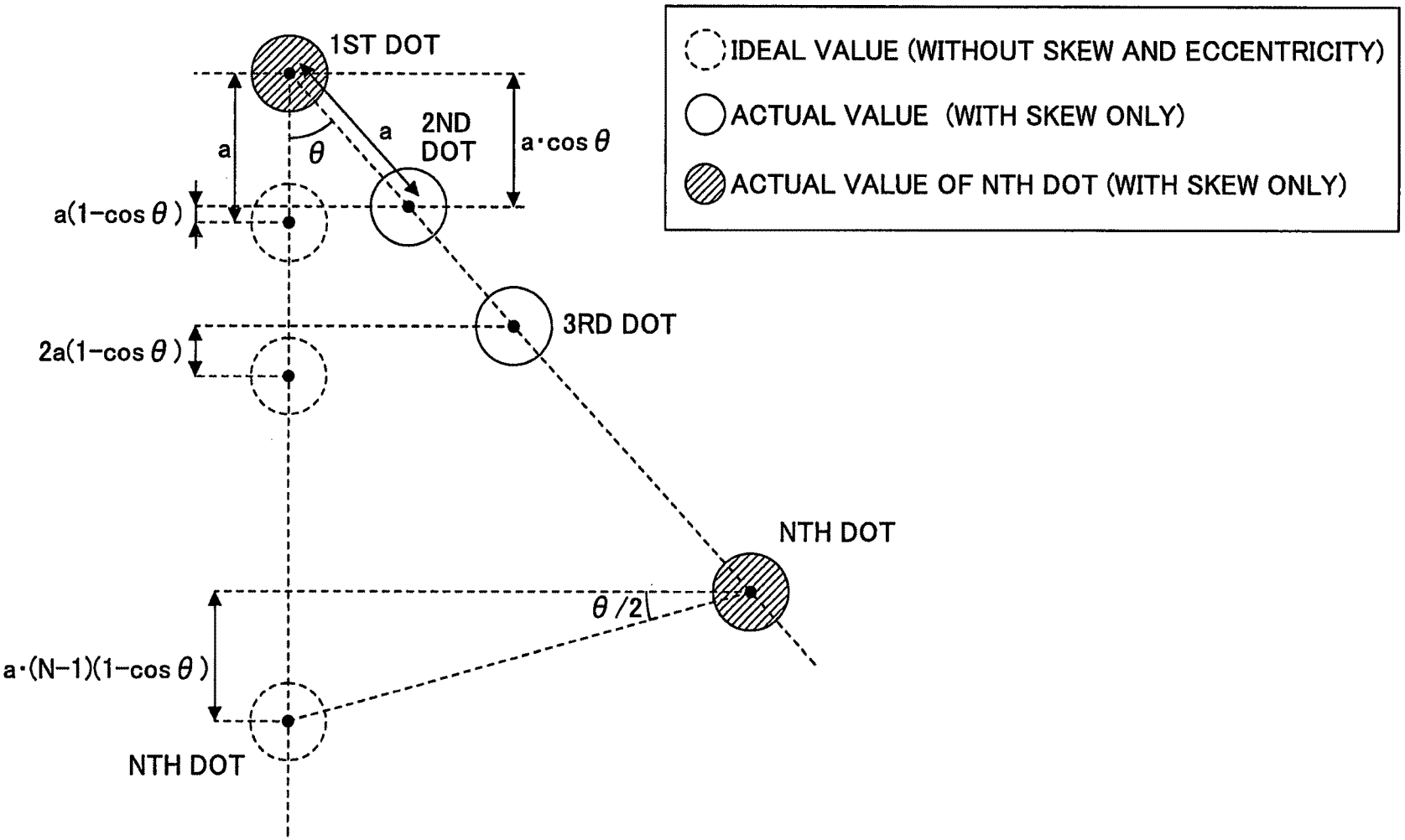
FIG. 16 is a drawing illustrating a relationship between the ideal positional information of marks in the ideal state where neither skew nor eccentricity is observed and actual positional information of the marks actually measured under a state where only skew is observed.
Figure 17:
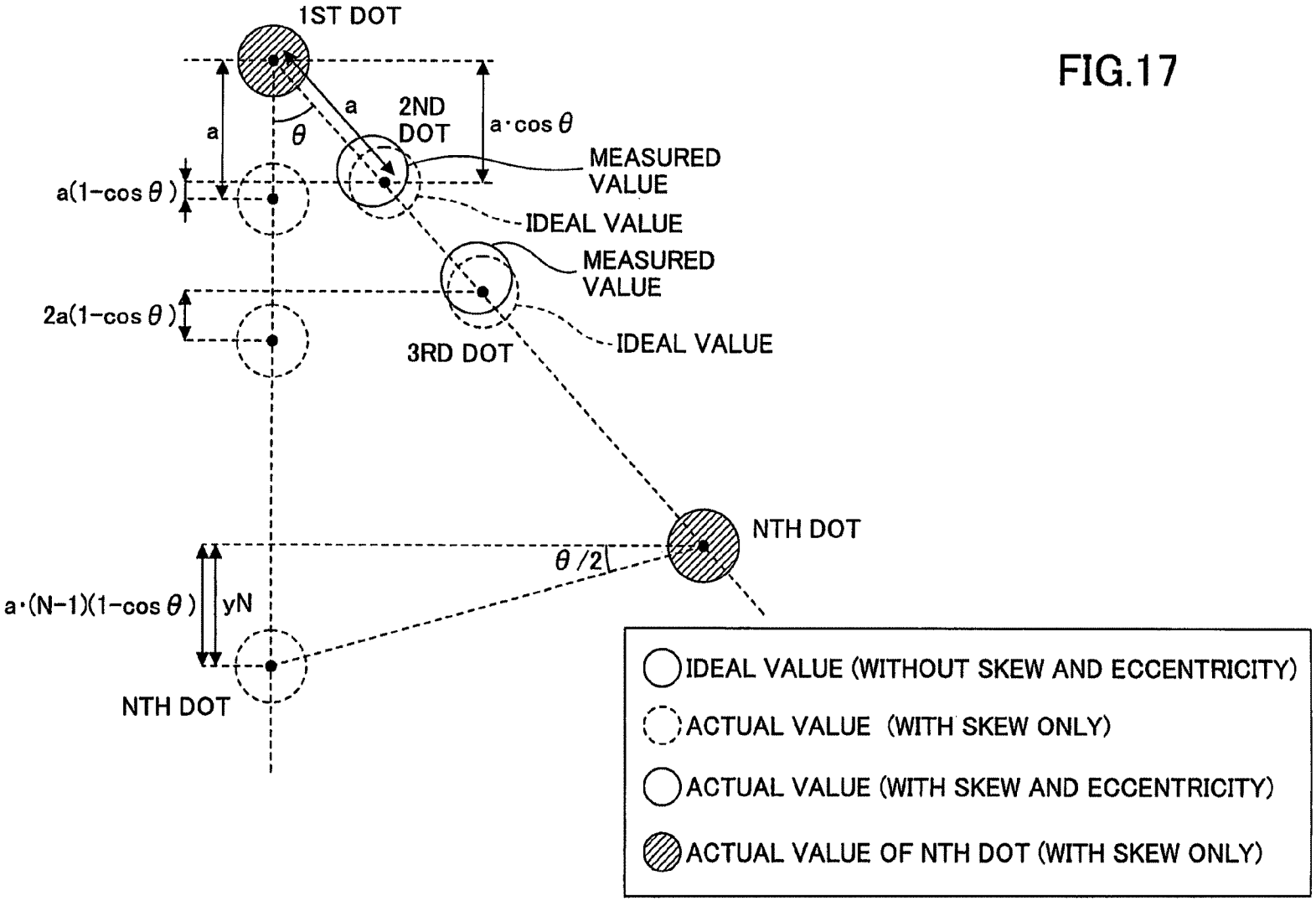
FIG. 17 is a drawing illustrating a relationship among the ideal positional information of marks in the ideal state where neither skew nor eccentricity is observed, ideal positional information of the marks actually measured under a state where only skew is observed; and the actual positional information of the marks actually measured under the state where both skew and eccentricity are observed.

Next, an example of a method of removing the accumulated errors in the sub-scanning direction, the accumulated errors being derived from the skew angle (θ), is described based on the relationship among 1) the ideally detected positional information of the marks (dots) 101, the positional information having neither the errors derived from the skew component nor the errors derived from the eccentricity component, 2) the actually detected positional information of the marks (dots) 101, the positional information having the errors derived from the skew component and the errors derived from the eccentricity component, and 3) the actually detected positional information of the marks (dots) 101, the positional information having only the errors derived from the skew (without errors derived from the eccentricity component) with reference to FIGS. 15 through 17.

When the feeding state of the feed roller 15 is not ideal (i.e., eccentricity is observed) and the test chart 100 is skewed, the actual positional information (actually measured data) of the marks (dots) 101 obtained by actually detecting using the two-dimensional sensor 30 include both the errors derived from the skew angle (θ) and the errors derived from the eccentricity, component as illustrated in FIG. 15. For example, the actual positional information (actually measured data) of the second mark (dot) 101 in FIG. 15 includes an error "y2" in the sub-scanning direction, the error "y2" including both the errors derived from the skew angle (θ) and the errors derived from the eccentricity component. In the same manner, the actual positional information (actually measured data) of the third mark (dot) 101 in FIG. 15 includes an error "y3" in the sub-scanning direction, the error "y3" including both the errors derived from the skew angle (θ) and the errors derived from the eccentricity component.

However, the actual positional information (actually measured data) of the Nth mark (dot) 101 obtained by actually detecting the Nth mark (dot) 101 using the two-dimensional sensor 30 when the feed roller 15 rotates one revolution does not include the error derived from the eccentricity component and includes an error derived from the skew angle (θ) only. For example, in the case of FIG. 15, the actual positional information (actually measured data) of the Nth mark (dot) 101 obtained by actually detecting the Nth mark (dot) 101 using the two-dimensional sensor 30 when the feed roller 15 rotates one revolution includes an error derived from the skew angle (θ) only as "yN".

Because of this feature, it may become possible to calculate (obtain) the accumulated errors (yN) derived from the skew angle (θ) by obtaining the difference (yN) between the actual positional information of the Nth mark (dot) 101 obtained by actually detecting the Nth mark (dot) using the two-dimensional sensor 30 when the feed roller 15 rotates one revolution and the positional information of the Nth mark (dot) 101 obtained by ideally detecting the Nth mark (dot) using the two-dimensional sensor 30 when the feed roller 15 rotates one revolution.

On the other hand, when the feeding state of the feed roller 15 is ideal (no eccentricity is observed) and the test chart 100 is skewed, the actual positional information (actually measured data) of the marks (dots) 101 obtained by actually detecting using the two-dimensional sensor 30 includes the accumulated errors (Δyn) derived from the skew angle (θ) only as illustrated in FIG. 16. In this case, the accumulated errors (Δyn) derived from the skew angle (θ) only are given in the following equation.

$$\Delta yn = L\cdot(n-1)\cdot(1-\cos\theta)$$

Here, the symbol "L" denotes the distance between the adjacent marks (dots) 101, and the symbol "n" denotes the number of marks (dots) ranging from 1 to N (N=1 through N).

For example, when assuming that "L=a" as illustrated in FIG. 16, the positional information (actually measured data) of the second mark (dot) 101 includes the error derived from the skew angle (θ) as "a(1−cos θ)". In the same manner, the positional information (actually measured data) of the third mark (dot) 101 includes the error derived from the skew angle (θ) as "2a(1−cos θ)". Further, the positional information (actually measured data) of the Nth mark (dot) 101 includes the error derived from the skew angle (θ) as "a·(N−1)·(1−cos θ)"

The difference ("yn" indicated in FIG. 15) between the actual positional information of the Nth mark (dot) 101 obtained by actually detecting the Nth mark (dot) using the two-dimensional sensor 30 when the feed roller 15 rotates one revolution and the positional information of the Nth mark (dot) 101 obtained by ideally detecting the Nth mark (dot) using the two-dimensional sensor 30 when the feed roller 15 rotates one revolution is given as the accumulated errors (ΔyN) derived from the skew angle (θ) only. Because of this feature, it may become possible to calculate (obtain) the accumulated errors (Δyn) derived from the skew angle (θ) only for the nth mark (dots) 101. Therefore, as illustrated in FIG. 17, it may become possible to calculate (obtain) the errors derived from the eccentricity component only by removing (subtracting) the accumulated errors (Δyn=L·(n−1)·(1−cos θ)) derived from the skew angle (θ) only at the nth mark (dot) 101 from the actual positional information (actually measured data: y2, y3, . . . , yN indicated in FIG. 15) of the nth mark (dots) 101 obtained by actually detected using the two-dimensional sensor 30. By doing in this way, it may become possible to calculate (obtain) the actual feeding amounts of the marks (dots) 101 including the error derived from the eccentricity component only by removing the accumulated errors derived from the skew angle (θ) only in the sub-scanning direction.

Example of Method of Controlling the Feed of the Feed Roller

Next, an example of a method of controlling the feed of the feed roller 15 performed in steps A7 and A8 in FIG. 10 is described with reference to FIG. 18.

For example, a case is described where the feed roller 15 is assumed to be rotated from the current state at the rotational position "3" to the target state (moving destination) at the rotational position "8".

In this case, the feeding amount error at the current position "3" is given as:

$$A\times\sin(\theta-\phi)=6\times\sin(60°-0°)=6\times\sin(60°)=6\times 0.866=5.196\text{ mm}$$

On the other hand, the feeding amount error at the destination position "8" is given as:

$$A\times\sin(\theta-\phi)=6\times\sin(210°-0°)=6\times\sin(210°)=6\times(-0.5)=-3.0\text{ mm}$$

Therefore, the correction amount (feeding amount error) to be used for correcting feeding amounts of the feed roller 15 is given as:

correction amount(feeding amount error)=(feeding amount error at the destination position)−(feeding amount error at the current position)=(−3.0)−(+5.196)=−8.196 mm Therefore, the feeding amount of the feed roller 15 corrected by using the correction amount (feeding amount error) is given as:

Corrected feeding amount of the feed roller 15=(feeding amount of the feed roller 15 without eccentricity)−(correction amount for correcting feeding amount)=150−(−8.196)=158.196 mm Therefore, in this case, the control section 107 controls the rotational position (rotational angle) of the feed roller 15 so that the actual feeding amount of the feed roller 15 is 158.196 mm.

By doing in this way, it may become possible to calculate (obtain) the correction amounts (feeding amount errors) to be used for correcting feeding amounts of the feed roller 15 based on the relationship between the rotational positions (rotational angles) of the feed roller 15 and the differences (the feeding amount errors), and control the feeding amount of the feed roller 15 based on the calculated correction amounts (feeding amount errors).

Figure 18:
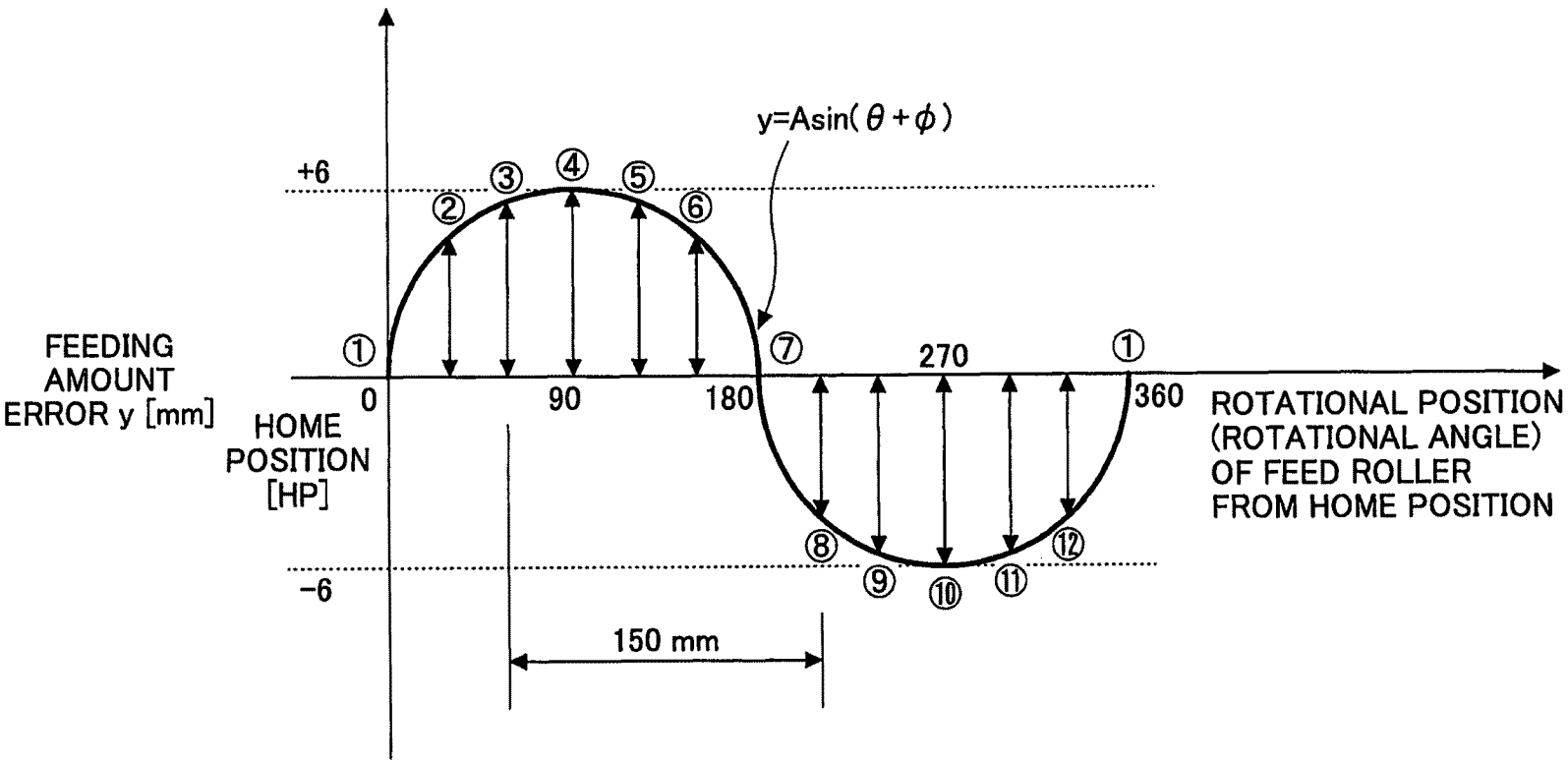
FIG. 18 is a drawing illustrating a control method of controlling feeding amounts of a feed roller.

Further, in the above description, a case is described where, in the relationship expressed in the waveform (A×sin(θ−ϕ)) of FIG. 18, the point where the feeding amount error is 0 mm corresponds to the point where the rotational angle of the feed roller 15 is 0 degree. However, it is not always the case that the point where the feeding amount error is 0 mm corresponds to the point where the rotational angle of the feed roller 15 is 0 degree as the reference position. This is why the formula A×sin(θ−ϕ) includes the parameter "ϕ". This parameter "ϕ" is the rotational angle to be rotated from the home position (HP) of the feed roller 15 to the position until the feeding amount error is 0 mm.

Operations and Effects of Recording Apparatus According to this Embodiment of the Present Invention As described above, in a recording apparatus according to this present invention, the feed roller 15 is rotated and the marks (dots) 101 arranged on the test chart 100 as illustrated in FIG. 2 are detected by using the two-dimensional sensor 30.

Then, the recording apparatus calculates the accumulated errors (ΔyN) in the sub-scanning direction derived from the skew angle (θ) only based on the positional information ($\alpha=(x_N,y_N)$) of the Nth mark (dot) 101 actually detected by the two-dimensional sensor 30 when the feed roller 15 rotates one revolution and the positional information ($\beta=(x_{N0},y_{N0})$) of the Nth mark (dot) 101 ideally detected by the two-dimensional sensor 30 when the feed roller 15 rotates one revolution.

Then, by removing (subtracting) the calculated accumulated errors (ΔyN) from the positional information of the marks (dots) 101 illustrated in FIG. 8 obtained by detecting the marks (dots) 101 using the two-dimensional sensor 30, the positional information of the marks (dots) 101 as illustrated in FIG. 5B marked as "with eccentricity" is obtained.

Then, the differences (feeding amount errors) between the positional information of the marks (dots) 101 as illustrated in FIG. 5B marked as "with eccentricity" and the positional information of the marks (dots) 101 as illustrated in FIG. 5A marked as "without eccentricity" are obtained by matching them to the corresponding rotational positions (rotational angles) of the feed roller 15.

Then, the relationship between the rotational positions (rotational angles) of the feed roller 15 and the differences (feeding amount errors) is approximated to a sine waveform as illustrated in FIG. 6.

Then, based on the relationship between the between the rotational positions (rotational angles) of the feed roller 15 and the differences (feeding amount errors) as illustrated in FIG. 6, the correction amounts (feeding amount errors) for correcting feeding amounts of the feed roller 15 is calculated. Then, based on the calculated correction amounts (feeding amount errors), the feeding amounts of the feed roller 15 are controlled.

By doing in this way, in the recording apparatus according to this embodiment of the present invention, it may become possible to reduce the variation of the feeding amounts in the sub-scanning direction by using the test chart 100 and stabilize the feeding amount per unit time of the feeding roller 15 at a constant value.

According to an embodiment of the present invention, a feed control apparatus includes a feed roller that feeds a medium; a first detection unit that detects a rotational position of the feed roller; a sensor that detects plural marks when a test chart is fed by the feed roller, the plural marks being arranged on the test chart, the test chart being provided for adjusting feeding amounts of the feed roller; a difference calculation unit that calculates a difference between actual positional information of an Nth (N: an integer) mark actually detected by the sensor when the feed roller rotates one revolution and theoretical positional information of the Nth mark ideally detected by the sensor when the feed roller rotates one revolution; a correction feeding amount calculation unit that calculates each of correction feeding amounts of the marks based on the differences calculated by the difference calculation unit and corresponding actual feeding amounts of the marks obtained by detecting the marks using the sensor; an error calculation unit that calculates each of errors between the correction feeding amounts of the marks calculated by the correction feeding amount calculation unit and corresponding predetermined theoretical feeding amounts by corresponding the errors to the rotational positions of the feeding roller; and a feeding amount control unit that controls the feeding amounts of the feed roller based on a relationship between the rotational positions of the feeding roller and the corresponding errors calculated by the error calculation unit.

According to an embodiment of the present invention, there is provided a recording apparatus for recording an image on a recording medium using a recording head discharging ink, the recording apparatus including the feed control apparatus as described above.

According to an embodiment of the present invention, there is provided a method of controlling a feed control apparatus controlling feeding of a medium. The method includes a first detection step of detecting a rotational position of a feed roller feeding the medium; a second detection step of detecting plural marks when a test chart is fed by the feed roller by using a sensor, the plural marks being arranged on the test chart, the test chart being provided for adjusting feeding amounts of the feed roller; a difference calculation step of calculating a difference between actual positional information of an Nth (N: an integer) mark actually detected by the sensor when the feed roller rotates one revolution and theoretical positional information of the Nth mark ideally detected by the sensor when the feed roller rotates one revolution; a correction feeding amount calculation step, of calculating each of correction feeding amounts of the marks based on the differences calculated in the difference calculation step and corresponding actual feeding amounts of the marks obtained by detecting the marks using the sensor; an error calculation step of calculating each of errors between the correction feeding amounts of the marks calculated in the correction feeding amount calculation step and corresponding predetermined theoretical feeding amounts by corresponding the errors to the rotational positions of the feeding roller; and a feeding amount control step of controlling the feeding amounts of the feed roller based on a relationship between the rotational positions of the feeding roller and the corresponding errors calculated in the error calculation step.

According to an embodiment of the present invention, there is provided a non-transitory computer-readable recording medium, comprising a program encoded and stored in a computer readable format to cause a computer to execute: a first detection process of detecting a rotational position of a feed roller feeding the medium; a second detection process of detecting plural marks when a test chart is fed by the feed roller by using a sensor, the plural marks being arranged on the test chart, the test chart being provided for adjusting feeding amounts of the feed roller; a difference calculation process of calculating a difference between actual positional information of an Nth (N: an integer) mark actually detected by the sensor when the feed roller rotates one revolution and theoretical positional information of the Nth mark ideally detected by the sensor when the feed roller rotates one revolution; a correction feeding amount calculation process of calculating each of correction feeding amounts of the marks based on the differences calculated in the difference calculation process and actual feeding amounts of the marks obtained by detecting the marks using the sensor; an error calculation process of calculating each of errors between the correction feeding amounts of the marks calculated in the correction feeding amount calculation process and corresponding predetermined theoretical feeding amounts by corresponding the errors to the rotational positions of the feeding roller; and a feeding amount control process of controlling the feeding amounts of the feed roller based on a relationship between the rotational positions of the feeding roller and the corresponding errors calculated in the error calculation process.

According to an embodiment of the present invention, it may become possible to reduce the variation of the feeding amounts of the feed roller.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

For example, in the above embodiment, a case is described where the marks (dots) 101 arranged on the test chart 100 are detected by using the two-dimensional sensor 30. However, the sensor for detecting the marks (dots) 101 arranged on the test chart 100 is not limited to the two-dimensional sensor 30. Namely, any other appropriate sensor may alternatively be used as long as the sensor can detect the positional information ($y_N$) in the y direction (sub-scanning direction) of the Nth mark (dot) 101 when the feed roller 15 rotates one revolution.

Further, for illustrative purposes, the apparatus according to the embodiment of the present invention is described with reference to the functional block diagrams. However, such an apparatus may be provided by hardware, software, or a combination thereof.

Further, when a process of the apparatus is to be executed by using software, a program having the relevant processing sequence may be installed in a memory of a computer incorporated in dedicated hardware and executed. Otherwise, the program may be installed in a general-purpose computer and executed.

For example, the program may be recorded in a recording medium such as a hard disk and ROM (ROM) in advance. Otherwise, the program may be temporarily or permanently stored (recorded) in a removable recording medium. Such a removable recording medium may be provided as package software. The removable recording medium includes a floppy (registered trademark) disk, a CD-ROM (Compact Disc Read Only Memory), an MO (Magneto Optical) disc, a DVD (Digital Versatile Disc), a magnetic disk, a semiconductor memory and the like.

Further, the program is installed from the removable recording medium to the computer. Otherwise, the program may be downloaded from a download site or may be transmitted via a wire line connected to a network.

Further, in the recording apparatus according an embodiment of the present invention, it is not always necessary to sequentially perform the processes as described above. For example, the processes may be performed in parallel or separately in accordance with the processing capacity of the apparatus to perform the processes or depending on the needs.

Further, in the above embodiment, in order to reduce the positional displacement of the image (dots) to be formed on the recording medium 16, the variation of the feeding amounts in the sub-scanning direction of the feed roller 15 is reduced. However, this technical concept may also be applied to a mechanism of a finisher and the like as long as the variation of the feeding amounts of the recording medium 16 can be reduced.

Further, the technical concept of the present invention is described using a recording apparatus. However, the application of the technical concept of the present invention is not limited to a recording apparatus. For example, the technical concept of the present invention may also be applied to a feed control apparatus controlling the feed of a medium other than the recording medium 16, such medium including, but not limited to, a laminate substrate and a card substrate.

The present invention may also be applied to an apparatus that controls the feeding of the medium.

What is claimed is:

1. A feed control apparatus comprising:

a feed roller that feeds a medium;

a first detection unit that detects a rotational position of the feed roller;

a two-dimensional sensor that detects, in two dimensions, plural marks when a test chart is fed by the feed roller, the plural marks being arranged on the test chart to represent predetermined points, the test chart being provided for adjusting feeding amounts of the feed roller;

a control section having a processor configured to, determine, in relation to an actual position of a first mark of the plural marks read by the two dimensional sensor, an actual position in a main scanning direction and in a sub-scanning direction of a second mark of the plural marks read by the two-dimensional sensor after the feed roller rotates one revolution subsequent to when the first mark is read, determine a theoretical position of the second mark in the sub-scanning direction based on a known distance in the sub-scanning direction between the first mark and the second mark, determine a skew angle of the test chart based on the actual position of the second mark in relation to the actual position of the first mark and the theoretical position of the second mark in the sub-scanning direction, correct a skew angle component from the actual position of the second mark based on the determined skew angle to produce a skewless actual position of the second mark in the sub-scanning direction, determine an error between the skewless actual position of the second mark in the sub-scanning direction and the theoretical position of the second mark in the sub-scanning, determine a rotational position of a deformity in the feed roller based on the determined error, and control a rotational speed of the feed roller based on the determined rotational position of the deformity and the determined error.

2. The feed control apparatus of claim 1, wherein the controller is configured to determine the skew angle of the test chart using a trigonometric relationship between the calculated actual position of the second mark, the skewless actual position of the second mark and the determined theoretical position of the second mark.

3. A recording apparatus for recording an image on a recording medium using a recording head discharging ink, the recording apparatus comprising:

the feed control apparatus according to claim 1.

4. A method of controlling a feed control apparatus controlling feeding of a medium, the method comprising:

detecting a rotational position of a feed roller feeding the medium;

detecting, in two dimensions, plural marks when a test chart is fed by the feed roller by using a two-dimensional sensor, the plural marks being arranged on the test chart to represent predetermined points, the test chart being provided for adjusting feeding amounts of the feed roller;

determining, in relation to an actual position of a first mark of the plural marks read by the two dimensional sensor, an actual position in a main scanning direction and in a sub-scanning direction of a second mark of the plural marks read by the two-dimensional sensor after the feed roller rotates one revolution subsequent to when the first mark is read;

determining a theoretical position of the second mark in the sub-scanning direction based on a known distance in the sub-scanning direction between the first mark and the second mark;

determining a skew angle of the test chart based on the actual position of the second mark in relation to the actual position of the first mark and the theoretical position of the second mark in the sub-scanning direction;

correcting a skew angle component from the actual position of the second mark based on the determined skew angle to produce a skewless actual position of the second mark in the sub-scanning direction;

determining an error between the skewless actual position of the second mark in the sub-scanning direction and the theoretical position of the second mark in the sub-scanning;

determining a rotational position of a deformity in the feed roller based on the determined error; and controlling a rotational speed of the feed roller based on the determined rotational position of the deformity and the determined error.

5. The method of claim 4, wherein the determining the skew angle of the test chart determines the skew angle using a trigonometric relationship between the calculated actual position of the second mark, the skewless actual position of the second mark and the determined theoretical position of the second mark.

6. A non-transitory computer-readable recording medium, comprising:

a program encoded and stored in a computer readable format which when executed on a computer causes the computer to execute:

detecting a rotational position of a feed roller feeding the medium, detecting, in two dimensions, plural marks when a test chart is fed by the feed roller by using a two-dimensional sensor, the plural marks being arranged on the test chart to represent predetermined points, the test chart being provided for adjusting feeding amounts of the feed roller, determining, in relation to an actual position of a first mark of the plural marks read by the two dimensional sensor, an actual position in a main scanning direction and in a sub-scanning direction of a second mark of the plural marks read by the two-dimensional sensor after the feed roller rotates one revolution subsequent to when the first mark is read, determining a theoretical position of the second mark in the sub-scanning direction based on a known distance in the sub-scanning direction between the first mark and the second mark, determining a skew angle of the test chart based on the actual position of the second mark in relation to the actual position of the first mark and the theoretical position of the second mark in the sub-scanning direction, correcting a skew angle component from the actual position of the second mark based on the determined skew angle to produce a skewless actual position of the second mark in the sub-scanning direction, determining an error between the skewless actual position of the second mark in the sub-scanning direction and the theoretical position of the second mark in the sub-scanning, determining the rotational position of a deformity in the feed roller based on the determined error, and controlling a rotational speed of the feed roller based on the determined rotational position of the deformity and the determined error.

7. The non-transitory computer-readable recording medium of claim 6, wherein the determining the skew angle of the test chart determines the skew angle using a trigonometric relationship between the calculated actual position of the second mark, the skewless actual position of the second mark and the determined theoretical position of the second mark.

* * * * *